US005114835A

United States Patent [19]

Sakanoue

[11] Patent Number: 5,114,835

[45] Date of Patent: May 19, 1992

[54] PROCESS FOR PROCESSING SILVER HALIDE COLOR PHOTOGRAPHIC MATERIAL

[75] Inventor: Kei Sakanoue, Kanagawa, Japan

[73] Assignee: Fuji Photo Film Co., Ltd., Kanagawa, Japan

[21] Appl. No.: 313,008

[22] Filed: Feb. 21, 1989

[30] Foreign Application Priority Data

Feb. 20, 1988 [JP] Japan ..... 63-37701

[51] Int. Cl.[5] ..... G03C 7/00

[52] U.S. Cl. ..... 430/393; 430/430; 430/461; 430/955

[58] Field of Search ..... 430/430, 393, 461, 955

[56] References Cited

U.S. PATENT DOCUMENTS

| | | | |
|---|---|---|---|
| 4,842,994 | 6/1989 | Sakanoue et al. | 430/393 |
| 4,865,959 | 9/1989 | Sakanoue et al. | 430/393 |
| 4,933,266 | 6/1990 | Stephen | 430/430 |
| 4,963,474 | 10/1990 | Fujita et al. | 430/393 |
| 5,002,860 | 3/1991 | Ishikawa et al. | 430/430 |

FOREIGN PATENT DOCUMENTS

| | | |
|---|---|---|
| 193389 | 7/1976 | European Pat. Off. . |
| 205121 | 12/1986 | European Pat. Off. . |

OTHER PUBLICATIONS

Patent Abstracts of Japan, vol. 12, No. 88 (p. 678) (2395) Mar. 23, 1988, Abstracting Japanese Patent Application JP-A-222252, Sep. 30, 1987.

Research Disclosure No. 24023 (Apr., 1984).

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A process for processing an imagewise exposed silver halide color photographic material with a processing solution having a bleaching ability after color development is disclosed, in which the silver halide color photographic material contains at least one compound capable of reacting with an oxidation product of a developing agent upon development to release a bleaching accelerator, and the processing solution having a bleaching ability contains (1) at least one ferric complex salt of a compound selected from the compound group (A) and (2) ferric complex salt of 1,3-diaminopropanetetraacetic acid as bleaching agents in such proportion that the molar ratio of the (1) to the (2) is 3 or less: compound group (A):

A-1; ethylenediaminetetraacetic acid
A-2; diethylenetriaminepentaacetic acid
A-3; cyclohexanediaminetetraacetic acid
A-4; 1,2-propylenediaminetetraacetic acid.

8 Claims, No Drawings

PROCESS FOR PROCESSING SILVER HALIDE COLOR PHOTOGRAPHIC MATERIAL

FIELD OF THE INVENTION

The present invention relates to a process for processing a silver halide color photographic material. More particularly, it relates to a process for processing a silver halide color photographic material with an improved desilvering speed.

BACKGROUND OF THE INVENTION

In general, fundamental steps of processing color light-sensitive materials are a color developing step and a desilvering step (i.e., a step removing silver). That is, exposed silver halide color photographic materials are introduced to the color-developing step. In this step, silver halide is reduced with a color developing agent to produce silver, and the oxidized color developing agent in turn reacts with a color former to provide a dye image. Then, the color photographic material is subjected to the desilvering. In this step, silver having been produced in the preceding step is oxidized by the action of an oxidant (commonly called bleaching agent, and then dissolved with a silver ion-complexing agent (commonly called fixing agent) to remove. Therefore, only dye images remain in the photographic materials having been subjected to these processing. In addition to the two fundamental steps of color development and silver removal (desilvering), practical development processing involves auxiliary steps for, for example, maintaining photographic and physical quality of images and improving shelf life of image. There are illustrated, for example, a hardening bath for preventing light-sensitive layers from being softened too much during processing, a stopping bath for effectively stopping development reaction, an image-stabilizing bath for stabilizing image, and a film-removing bath for removing a packing layer of a support.

The above-described desilvering step may be conducted in two manners: in one step, silver removal (desilvering) is conducted in two steps using separately a bleaching bath and a fixing bath; in another manner, silver removal is conducted in one step using a bleach-fixing bath wherein a bleaching agent and a fixing agent are allowed to coexist for accelerating the processing and saving work, thus the processing being conducted more simply.

In recent processing of color photographic light-sensitive materials, a bleaching process using mainly a ferric ion complex salt (for example, iron(III) aminopolycarboxylate complex salts, particularly iron(III) ethylenediaminetetraacetate complex salt) is predominantly employed in view of acceleration and simplification of the processing and prevention of environmental pollution.

However, ferric ion complex salts have a comparatively small oxidizing ability and, therefore, show an insufficient bleaching power. Hence, a bleaching or bleach-fixing processing using the ferric ion complex salt has the defect that, though the salt provide satisfactory results with, for example, low-speed silver halide color photographic material containing mainly a silver chlorobromide emulsion, it shows only insufficient bleaching action to cause insufficient removal of silver or require a long time for bleaching with respect to high-speed silver halide color photographic materials containing mainly a silver chlorobromoiodide emulsion or a silver bromoiodide emulsion and having been color-sensitized, particularly color light-sensitive materials and color negative light-sensitive materials for photographing use.

As bleaching agents other than the ferric ion salts, there are known persulfates which are usually used together with chlorides as a bleaching solution. However, a bleaching solution using the persulfate has the defect that the persulfate has weaker bleaching power than the ferric ion complex salts and therefore requires a extremely long time for bleaching.

In general, bleaching agents causing no environmental pollution or having no corrosive properties to apparatuses have a weak bleaching power. Thus, it has been desired to increase bleaching ability of a bleaching or bleach-fixing solution using a bleaching agent with a weak bleaching power, particularly a ferric ion complex salt or a persulfate salt.

For this purpose, Research Disclosure No. 24023 (April, 1984), JP-A-230653 (The term "JP-A" as used herein means an "unexamined published Japanese Patent application"), etc. describe processings of using two or more of various iron(III) aminopolycarboxylate complex salts. These processings, however, fail to provide satisfactory results.

On the other hand, Research Disclosure, No. 24241 and ibid., No. 11449, and JP-A-61-201247 give descriptions regarding bleaching accelerator-releasing couplers.

It is described therein that the use of these couplers serve to shorten bleaching time. However, the use of these couplers is still insufficient and, when bleaching time is greatly shortened, there results insufficient silver removal (i.e., insufficient desilvering). In addition, it has become apparent that, they have a serious defect that the effect of these couplers is descreased in running state in continuous processing using an automatic developing machine, which is an ordinary processing manner.

SUMMARY OF THE INVENTION

An object of the present invention is, therefore, to provide a process for processing a silver halide photographic material containing a bleaching accelerator-releasing coupler, which enables to attain a practically sufficient bleaching speed even when bleaching speed of a bath with a bleaching ability is accelerated.

Another object of the present invention is to provide a bleaching bath containing a bleaching agent, which does not cause reduction of the effect of bleaching accelerator-releasing couplers even in a running state.

These and other objects of the present invention will become apparent from the following description thereof.

The above-described and other objects of the present invention are attained by a process for processing exposed silver halide color photographic materials, which comprises processing an imagewise exposed silver halide color photographic material with a processing solution having a bleaching ability after color development, the silver halide color photographic material containing at least one compound capable of reacting with an oxidation product of a developing agent upon development to release a bleaching accelerator (bleaching accelerator-releasing compound), and the processing solution having a bleaching ability containing (1) at least one ferric complex salt of a compound selected from the compound group (A) and (2) ferric complex salt of 1,3-diaminopropanetetraacetic acid as bleaching agents in such proportion that the molar ratio of the (1) the ferric complex salt of the compound selected from the compound group (A) to (2) the ferric complex salt of 1,3-diaminopropanetetraacetic acid is 3 or less. compound group (A):

A-1: ethylenediaminetetraacetic acid
A-2: diethylenetriaminepentaacetic acid
A-3: cyclohexanediaminetetraacetic acid
A-4: 1,2-propylenediaminetetraacetic acid

DETAILED DESCRIPTION OF THE INVENTION

The bleaching accelerator-releasing compounds (i.e., a compound capable of reacting with an oxidation product of a developing agent upon development to release a bleaching accelerator) to be used in the present invention are preferably those represented by formula (I):

$$A-(T_1)_l-[B-(T_2)_n]_m-Z \quad (I)$$

In formula (I), A represents a group which is to be clove from $(T_1)_l-[B-(T_2)_n]_m-Z$ upon reaction with an oxidation product of an aromatic primary amine developing agent. $T_1$ and $T_2$ each represents a timing group. B represents a group which is to be clove from $T_2$ upon reaction with an oxidation product of an aromatic primary amine developing agent after A is clove from $(T_1)_l-[B-(T_2)_n]_m-Z$. Z represents a group showing a bleach-accelerating effect after B is clove from $T_2$, and l, m and n each represents an integer of 0 or 1.

In formula (I), A particularly represents a coupler residue or a reducing agent residue.

As the coupler residue represented by A, known ones may be used. For example, there are illustrated yellow coupler residues (e.g., open-chain ketomethylene type coupler residues), magenta coupler residues (e.g., 5-pyrazolone type, pyrazoloimidazole type and pyrazolotriazole type coupler residues), cyan coupler residues (e.g., phenolic and naphtholic couplers) and colorless compound forming coupler residues (e.g., indanone type and acetophenone type coupler residues). Preferably the coupler residue represented by A is cyan coupler residues. In addition, heterocyclic coupler residues described in European Patent 249453, U.S. Pat. Nos. 4,315,070, 4,183,752, 3,961,959 or 4,171,223 may also be used.

In formula (I), preferable examples of A when A represents a coupler residue include those which are represented by the following formulae (Cp-1), (Cp-2), (Cp-3), (Cp-4), (Cp-5), (Cp-6), (Cp-7), (Cp-8), (Cp-9) and (Cp-10). These couplers show a fast coupling rate, thus being preferred.

Formula (Cp-1)

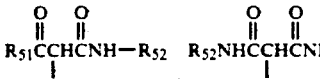

Formula (Cp-2)

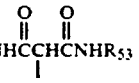

-continued

Formula (Cp-3)

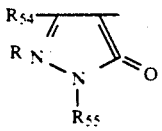

Formula (Cp-4)

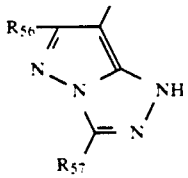

Formula (Cp-5)

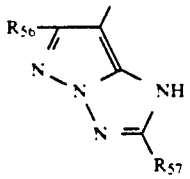

Formula (Cp-6)

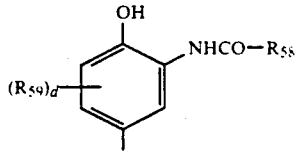

Formula (Cp-7)

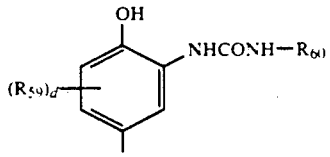

Formula (Cp-8)

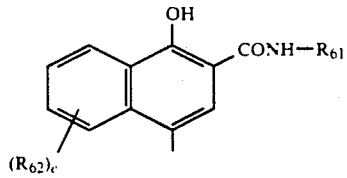

Formula (Cp-9)

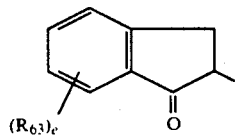

Formula (Cp-10)

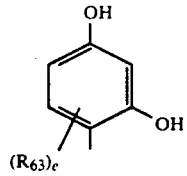

In the above formulae, the free bond at the coupling position represents a bond position of the coupling releasable group.

In the above formulae, when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ contains a diffusion-resistant group, A total number of carbon atoms of $R_{51}$ to $R_{63}$ each is generally from 8 to 40 and preferably from 10 to 30, and when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ does not contain a diffusion-resistant group, the total carbon atom number is preferably up to 15. With bis-, teromer- or polymer-type couplers, one of the above-described $R_{51}$ to $R_{63}$ represents a divalent group to link repeating units or the like. In this case, the number of carbon atoms may be outside the above-specified scope.

$R_{51}$ to $R_{63}$, d and e are described in detail below. In the following description, $R_{41}$ represents an aliphatic group, an aromatic group or a heterocyclic group, $R_{42}$ represents an aromatic group or a heterocyclic group, and $R_{43}$, $R_{44}$ and $R_{45}$ each represents a hydrogen atom, an aliphatic group, an aromatic group or a heterocyclic group.

$R_{51}$ is the same as defined for $R_{41}$. $R_{52}$ and $R_{53}$ each is the same as defined for $R_{42}$. $R_{54}$ is the same as defined for $R_{41}$ or represents $$R_{41}\underset{\underset{R_{43}}{|}}{CON}-,\ R_{41}\underset{\underset{R_{43}}{|}}{N}-,\ R_{41}SO_2\underset{\underset{R_{43}}{|}}{N}-,\ R_{41}S-,\ R_{43}O-,$$

$$R_{45}\underset{\underset{R_{43}}{|}}{N}-\underset{\underset{R_{44}}{|}}{CON}-\ \text{or}\ N\equiv C-.$$

$R_{55}$ is the same as defined for $R_{41}$. $R_{56}$ and $R_{57}$ each is the same as defined for $R_{43}$ or represents $R_{41}S-$, $R_{43}O-$, $$R_{41}\underset{\underset{R_{43}}{|}}{CON}-\ \text{or}\ R_{41}SO_2\underset{\underset{R_{43}}{|}}{N}-.$$

$R_{58}$ is the same as defined for $R_{41}$. $R_{59}$ is the same as defined for $R_{41}$ or represents $$R_{41}\underset{\underset{R_{43}}{|}}{CON}-,\ R_{41}O\underset{\underset{R_{43}}{|}}{CON}-,\ R_{41}SO_2\underset{\underset{R_{43}}{|}}{N}-,\ R_{43}\underset{\underset{R_{44}}{|}}{N}-\underset{\underset{R_{45}}{|}}{CON}-,$$

$R_{41}O-$, $R_{41}S-$, a halogen atom or $$R_{41}\underset{\underset{R_{43}}{|}}{N}-.$$

d represents from 0 to 3. When d represents 2 or 3, two or more $(R_{59})$s represent the same or different substituents. Each $R_{59}$ may be a divalent group to link to each other and form a cyclic structure. The divalent group for forming the cyclic structure are typically exemplified by the following:

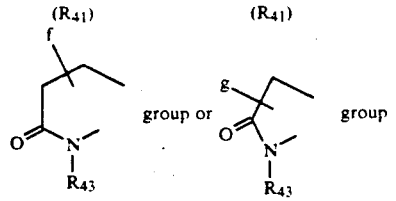

wherein f is an integer of 0 to 4, and g represents an integer of 0 to 2. $R_{60}$ is the same as defined for $R_{41}$ $R_{61}$ is the same as defined for $R_{41}$. $R_{62}$ is the same as defined for $R_{41}$ or represents $R_{41}OCONH-$, $R_{41}SO_2NH-$, $$R_{43}\underset{\underset{R_{44}}{|}}{N}-\underset{\underset{R_{45}}{|}}{CON}-,\ R_{43}\underset{\underset{R_{44}}{|}}{N}-\underset{\underset{R_{45}}{|}}{SO_2N}-,$$

$R_{43}O-$, $R_{41}S-$, a halogen atom or $$R_{41}\underset{\underset{R_{43}}{|}}{N}-.$$

$R_{63}$ is the same as defined for $R_{41}$ or represents $$R_{43}\underset{\underset{C_{44}}{|}}{CO}-\underset{\underset{R_{45}}{|}}{N}-,\ R_{43}\underset{\underset{R_{44}}{|}}{NCO}-,\ R_{41}SO_2\underset{\underset{R_{44}}{|}}{N}-,\ R_{43}\underset{\underset{R_{44}}{|}}{NSO_2}-,$$

$R_{41}SO_2-$, $R_{43}OCO-$, $R_{43}O-SO_2-$, a halogen atom, a nitro group, a cyano group or $R_{43}CO-$. e represents an integer of 0 to 4. When two or more $(R_{62})_5$ or $(R_{63})$s exist, they may be the same or different.

In the above description, the aliphatic group is a saturated or unsaturated, chained (straight or branched) or cyclic, substituted or unsubstituted aliphatic hydrocarbon group containing generally 1 to 32 and preferably 1 to 22, carbon atoms. Typical examples thereof include a methyl group, an ethyl group, a propyl group, an isopropyl group, a butyl group, a (t)-butyl group, an (i)-butyl group, a (t)-amyl group, a hexyl group, a cyclohexyl group, a 2-ethylhexyl group, an octyl group, a 1,1,3,3-tetramethylbutyl group, a decyl group, a dodecyl group, a hexadecyl group and an octadecyl group.

The aromatic group is preferably a substituted or unsubstituted phenyl group containing 6 to 20 carbon atoms or a substituted or unsubstituted naphthyl group containing 6 to 20 carbon atoms.

The heterocyclic group is preferably a 3- to 8-membered, substituted or unsubstituted heterocyclic group containing generally 1 to 10 and preferably 1 to 7, carbon atoms and containing a hetero atom or atoms selected from among a nitrogen atom, an oxygen atom and a sulfur atom. Typical examples of the heterocyclic group include a 2-pyridyl group, a 2-thienyl group, a 2-furyl group, a 1-imidazolyl group, a 1-indolyl group, a phthalimido group, a 1,3,4-thiadiazol - 2-yl group, a 2-quinolyl group, a 2,4-dioxo-1,3-imidazolidin-5-yl group, a 2,4-dioxo-1,3-imidazolidin-3-yl group, a succinimido group, a 1,2,4-triazol-2-yl group or a 1-pyrazolyl group.

Typical examples of the substituents optionally used for the foregoing aliphatic hydrocarbon group, aromatic group and heterocyclic group include a halogen atom, $$R_{47}O-,\ R_{46}S-,\ R_{47}\underset{\underset{R_{48}}{|}}{CON}-,\ R_{47}\underset{\underset{R_{48}}{|}}{NCO}-,\ R_{46}O\underset{\underset{R_{47}}{|}}{CON}-,$$

$$R_{46}SO_2\underset{\underset{R_{47}}{|}}{N}-,\ R_{47}\underset{\underset{R_{48}}{|}}{NSO_2}-,\ R_{46}SO_2-,\ R_{47}OCO-,$$

$$R_{47}\underset{\underset{R_{48}}{|}}{N}-\underset{\underset{R_{49}}{|}}{CON}-,\ \text{the same as defined for } R_{46},$$

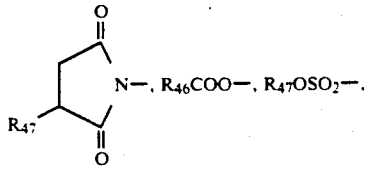

a cyano group or a nitro group, wherein $R_{46}$ represents an aliphatic group, an aromatic group or a heterocyclic group, and $R_{47}$, $R_{48}$ and $R_{49}$ each represents an aliphatic group, an aromatic group, a heterocyclic group or a hydrogen atom. The terms "aliphatic group", "aromatic group" and "heterocyclic group" mean the same as defined for hereinbefore.

The coupler residue represented by formula (Cp-1) is specifically described in, for example, U.S. Pat. Nos. 3,933,501, 4,022,620, 4,326,024, 4,401,752, JP-B-58-10739 (The term "JP-B" as used herein means an "examined Japanese patent publication"), British Patents 1,425,020, 1,476,760, 249,473, etc.

The coupler residue represented by formula (Cp-2) is specifically described in, for example, U.S. Pat. No. 4,149,886, British Patent 1,204,680, and JP-A-52-154631.

The coupler residue represented by formula (Cp-3) is specifically described in, for example, JP-A-49-111631, JP-A-54-48540, JP-A-55-62454, JP-A-55-118034, JP-A-56-38045, JP-A-56-80045, JP-A-56-126833, JP-A-57-4044, JP-A-57-35858, JP-A-57-94752, JP-A-58-17440, JP-A-58-50537, JP-A-58-85432, JP-A-58-117546, JP-A-58-126530, JP-A-58-145944, JP-A-58-205151, JP-A-54-170, JP-A-54-10491, JP-A-54-21258, JP-A-53-46452, JP-A-53-46453, JP-A-57-36577, JP-A-60-2953, JP-A-60-23855, JP-A-60-170854, U.S. Pat. Nos. 3,227,554, 3,432,521, 4,310,618, 4,351,897, etc.

The coupler residue represented by formula (Cp-4) or (Cp-5) is specifically described in, for example, International Publication (PCT) WO 86/01915 and WO 86/02467, European Patent Laid Open No. 182617, U.S. Pat. Nos. 3,061,432, 3,705,896, 3,725,067, 4,500,630, 4,540,654, 4,548,899, 4,581,326, 4,607,002, 4,621,046, 4,675,280, JP-A-59-228252, JP-A-60-33552, JP-A-60-43659, JP-A-60-55343, JP-A-60-57838, JP-A-60-98434, JP-A-60-107032, JP-A-61-53644, JP-A-61-65243, JP-A-61-65245, JP-A-61-65246, JP-A-61-65247, JP-A-61-120146, UP-A-61-120147, JP-A-61-120148, JP-A-61-120149, JP-A-61-120150, JP-A-61-120151, JP-A-61-120152, JP-A-61-120153, JP-A-61-120154, JP-A-61-141446, JP-A-61-144647, JP-A-61-147254, JP-A-61-151648, JP-A-61-180243, JP-A-61-228444, JP-A-61-230146, JP-A-61-230147, JP-A-61-292143, etc.

The coupler residue represented by formula (Cp-6), (Cp-7) or (Cp-8) is specifically described in, for example U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (OLS) 3,329,729, European Patent 121,265A, U.S. Pat. Nos. 3,446,622, 4,333,999, 4,451,559, 4,427,767, and 4,554,244, European Patents 161,626A, 175,573, 250,201, etc.

The coupler residue represented by formula (Cp-9) is specifically described in, for example, U.S. Pat. Nos. 3,932,185, 4,063,950 etc.

The coupler residue represented by formula (Cp-10) is specifically described in, for example, U.S. Pat. No. 4,429,035.

Typical examples of the coupler residue represented by formula (Cp-1) are disclosed by compound examples (Y-1) to (Y-34) in Japanese Patent Application No. 62-226050. Similarly, typical examples of the coupler residue represented by formula (Cp-3) are disclosed by compound examples (M-1) to (M-56}, typical examples of the coupler residue represented by formula (Cp-4) and (Cp-5) are disclosed by compound examples (M-57) to (M-108), typical examples of the coupler residues represented by formulae (Cp-6) and (Cp-7) are disclosed by compound examples (C-1) to (C-56), and typical examples of the coupler residues represented by formula (Cp-8) are disclosed by compound examples (C-57) to (C-86).

The compounds represented by formula (I) may be dimers or polymers wherein two or more of the units are bound to each other at a position other than Z (preferably at A), and specific examples thereof are described in, for example, Japanese Patent Application No. 62-90442.

As the reducing agent residue represented by A, known one may be used, and reducing agent residues described in Japanese Patent Application No. 62-203997 and represented by formula (II) on page 78 to formula (IV) on page 85 (for example, residues having the structures of derivatives of hydroquinone, naphthohydroquinone, catechol, pyrogallol, aminophenol and gallic acid) are popular.

In formula (I), the timing group represented by $T_1$ or $T_2$ is properly used for various purposes (for example, controlling coupling activity). Examples of the timing group are shown by items (1) to (5) and (7) described in Japanese Patent Application No. 62-186939 on pages 23 to 36. Of these, timing groups represented by formulae (T-1), (T-2) and (T-3) are preferable.

The group represented by B in formula is a group which, after A is clove from $(T_1)_l-[B-(T_2)_n]_m-Z$ and then $(T_1)_l$ is clove from $[B-(T_2)_n]_m-Z$ and further when B is clove from $T_2$ and Z, functions as a coupler or a reducing agent (for example, a derivative of hydroquinone, naphthohydroquinone, catechol, pyrogallol, aminophenol or gallic acid) to release $(T_2)$ and Z by coupling reaction or oxidation-reduction reaction.

For example, there are related descriptions in U.S. Pat. Nos. 4,618,571 and 4,438,193, JP-A-60-203943, JP-A-60-213944 and JP-A-61-236551, and specific examples thereof are illustrated below.

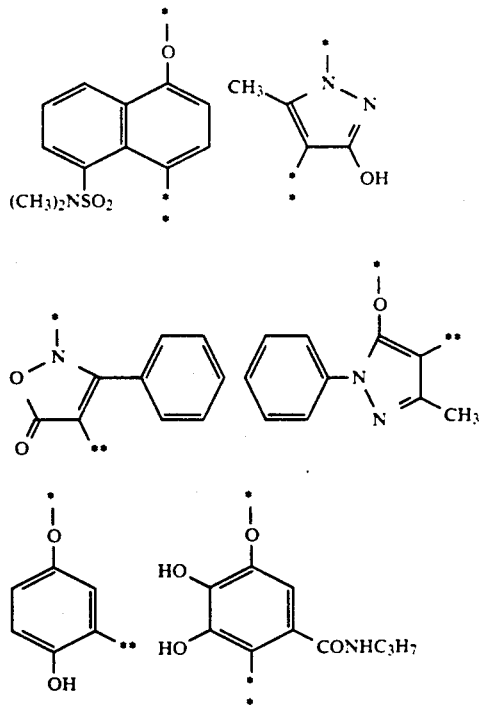

-continued

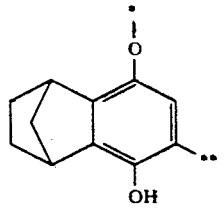

In the above formulae, * represents a linking position to $T_1$, and ** represents a linking position to $T_2$.

$T_1$, $T_2$ and B may properly be utilized according to intended purposes, but are not preferably used in general.

The group represented by Z in formula (I) is exemplified in detail by known bleaching accelerator residues. For example, there are illustrated various mercapto compounds as described in U.S. Pat. No. 3,893,858, British patent 1,138,842, and JP-A-53-141623, compounds having disulfido bond as described in JP-A-53-95630, thiazolidine derivatives as described in JP-B-53-9854, isothiourea derivatives as described in JP-A-53-94927, thiourea derivatives as described in JP-B-45-8506 and JP-B-49-26586, thioamide compounds as described in JP-A-49-42349, dithiocarbamates as described in JP-A-55-26506, and arylenediamine compounds as described in U.S. Pat. No. 4552834. Of these compounds, those wherein Z is bound to $A-(T_1)_l-[B-(T_2)_n]_m-$ in formula (I) through a hetero atom that can be substituted, contained in the molecule are preferable.

More preferably, the group represented by Z is represented by the following formula (Z-1), (Z-2), (Z-3), (Z-4) or (Z-5).

Formula (Z-1):

$$-S-L_1-(X_1)_a$$

In formula (Z-1), a represents an integer of from 1 to 4, $L_1$ represents a straight or branched alkylene group of a valency of (a+1) containing 1 to 8 carbon atoms, and $X_1$ represents a hydroxy group, a carboxyl group, a cyano group, an amino group containing 0 to 10 carbon atoms (for example, amino, methylamino, ethylamino, dimethylamino, diethylamino, diisopropylamino, pyrrolidino, piperidino, morpholino or hydroxylamino), an acyl group containing 1 to 10 carbon atoms (e.g., formyl or acetyl), a heterocyclic thio group containing 1 to 10 carbon atoms (e.g., 4-pyridylthio or imidazolylthio), a carbamoyl group containing 1 to 10 carbon atoms. (e.g., carbamoyl, dimethylcarbamoyl, hydroxycarbamoyl or morpholinocarbonyl), a sulfonyl group containing 1 to 10 carbon atoms (e.g., methylsulfonyl or ethylsulfonyl), a heterocyclic group containing 1 to 10 carbon atoms (e.g., pyridyl or imidazolyl), a sulfamoyl group containing 0 to 10 carbon atoms (e.g., sulfamoyl, methylsulfamoyl, dimethylsulfamoyl or pyrrolidinosulfonyl), a carbonamide group containing 1 to 10 carbon atoms (e.g., formamido or acetamido), an ammoniumyl group containing 3 to 12 carbon atoms (e.g., trimethylammoniumyl or pyridiniumyl), an ureido group containing 1 to 10 carbon atoms (e.g., ureido or 3-methylureido), a sulfamoylamino group containing 0 to 10 carbon atoms (e.g., sulfamoylamino or 3,3-dimethylsulfamoylamino), an alkoxy group containing 1 to 6 carbon atoms (e.g., methoxy), an amidino group a guanidino group or an amidinothio group, provided that, when a represents 2 or more a plurality of $(X_1)$s may be the same or different, and that $L_1$ does not represent a cycloalkylene group. Specific examples of $L_1$ are methylene, ethylene, trimethylene, ethylidene, isopropylidene, propylene, 2,3-propanetriyl, etc.

Formula (Z-2):

$$-S-L_2-(Y_1-L_3)_b-X_1 \quad (X_2)_c$$

In formula (Z-2), b represents an integer of 1 to 6, c represents an integer of 0 to 7, $L_2$ and $L_3$ each represents a straight or branched chain alkylene group containing 1 to 8 carbon atoms, $X_1$ and $X_2$ are the same as defined for $X_1$ in formula (Z-1), and $Y_1$ represents $$-O-,\ -S-,\ -SO-,\ -SO_2-,\ -\underset{R_1}{N}-,\ -\underset{R_1}{CON}-,$$

$$-\underset{R_1}{NCO}-,\ -CO-,\ -\underset{R_1}{N}SO_2\underset{R_2}{N}-,\ -SO_2\underset{R_1}{N}-,\ -COO-,$$

$$-OCO-,\ -OCOO-,\ -\underset{R_1}{OCON}-,\ -\underset{R_1}{NCOO}-\ \text{or}$$

$$-\underset{R_1}{NSO_2}-$$

(provided that $R_1$ and $R_2$ each represents a hydrogen atom or an alkyl group containing 1 to 10 carbon atoms (for example, methyl, ethyl, hydroxymethyl or hydroxyethyl, methoxyethyl, carboxymethyl, carboxyethyl or propyl)), provided that, when b represents 2 or more, a plurality of $(Y_1-L_3)$s may be the same or different, (but there is no fact that all of $Y_1$ are —S—.) and that, when c is other than 0, $X_2$ may, if possible, be replaced by any of $L_2$, $Y_1$ and $L_3$.

Formula (Z-3):

$$-W-L_2-(S-L_3)_b-X_1 \quad (X_2)_c$$

In formula (Z-3), b, c, $L_2$, $L_3$, $X_1$ and $X_2$ are the same as defined for b, c, $L_2$, $L_3$, $X_1$ and $X_2$ in formula (Z-2), and W represents —O—, —S—, —OCO—, $-OSO_2-$, —OSO—, $$-\underset{R_3}{N}-\ \text{or}\ -W_1-L_4-\underset{R_3}{N}-$$

wherein $R_3$ in the same as defined for $R_1$ in formula (Z-2), $L_4$ is the same as defined for $L_2$, and $W_1$ represents —O—, —OCO—, $-OSO_2-$, —OSO— or —N—, provided that, when b represents 2 or more, a plurality of $(S-L_3)$s may be the same or different and that when c is other than 0, $X_2$ may, if possible, be replaced by any of W, $L_2$ and $L_3$ with the proviso that, when W is —S—, b does not represent 1.

Formula (Z-4):

-continued

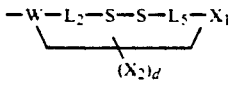

In formula (Z-4), W, $X_1$ and $X_2$ are the same as defined for W, $X_1$ and $X_2$ in formula (Z-3), respectively, d' represents an integer of 0 to 6, and $L_4$ and $L_5$ each represents a linking group containing a total carbon of 1 to 16 carbon atoms (for example, alkylene or alkylenes bond to each other through —O—, —S— or Formula (Z-4).

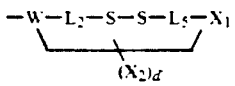

wherein $R_4$ is the same as defined for $R_1$ in formula (Z-2), provided that, when d' is other than 0, $X_2$ may, if possible, be replaced by any of W, $L_4$ and $L_5$.

Formula (Z-5):

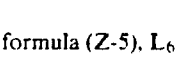

In formula (Z-5), $L_6$ represents a cycloalkylene group containing 3 to 12 carbon atoms (for example, a group derived from cyclopropane, cyclobutane, cyclopentane, methylcyclopentane, cyclohexane, cyclopentanone, cyclohexanone or bicyclo(2,2,1)pentane), an arylene group containing 6 to 10 carbon atoms (for example, phenylene or naphthylene), an unsaturated heterocyclic group containing 1 to 10 carbon atoms (for example a group derived from pyrrole, pyrazole, imidazole, 1,2,3-triazole, 1,2,4-triazole, tetrazole, oxazole, thiazole, indole, indazole, benzimidazole, benzoxazole, benzothiazole, 1,3,4-oxadiazole, 1,3,4-thiadiazole, purine, tetraazaindene, isoxazole, isothiazole, pyridine, pyrimidine, pyridazine, 1,3,5-triazine, quinoline, furan, thiophene) or a saturated heterocyclic group containing 2 to 10 carbon atoms and optionally being partially saturated (for example, oxirane, thiirane, aziridine, oxetane, oxorane, thiorane, thiethane, oxane, thiane, dithione, dioxane, piperidine, morpholine, piperadine, imidazolidine, pyrrolidine, pyrazoline, pyrazolidine, imidazoline, pyran, thiopyran, oxazoline, sulfolane, etc.).

In formula (Z-5), $X_3$ represents a hydrophilic substituent having a $\pi$ substituent constant of preferably up to 0.5, more preferably a minus value. The term "$\pi$ substituent constant" as used herein means the value calculated on $X_3$ according to the method described in C. Hansch & A. Leo; *Substituent constants for Correlation Analysis in Chemistry and Biology* (john Wiley, 1979), and are illustrated below ($\pi$ substituent constants being given in parentheses): $—CONH_2$(—1.49) $—CO_2H$ (−0.32) $—COCH_3$(−0.55) $—NHCOCH_3$ (−0.97) $—CH_2CH_2CO_2H$(−0.29) $—CH_2CH_2NH_2$ (0.08) $—SCH_2CO_2H$(−0.31)

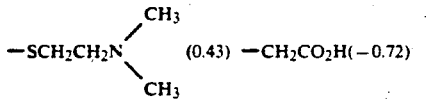

-continued $—SCH_2CONH_2$(−0.97) $—SCH_2C(=O)—CH_3$(0.43)

$—SCH_2CH_2CO_2H$(−0.01) —OH(−0.67)

—CONHOH(−0.38) $—CH_2OH$(−1.03) —CN (−0.57) $—CH_2CN$(−0.57) $—CH_2NH_2$

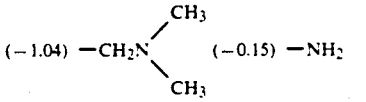

$—NHCHO$(−0.98) $—NHCONH_2$ (−1.30) $—NHCH_3$(−0.47) $—NHSO_2CH_3$

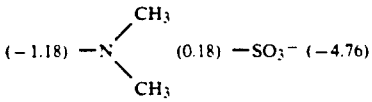

$—N(SO_2CH_3)_2$(−1.51) $—OCONH_2$(−1.05)

$—OCH_3$(−0.02) $—OSO_2CH_3$(−0.88)

$—OCOCH_3$(−0.64) $—OCH_2COOH$(−0.87)

$—SO_2NH_2$(−1.82) $—SO_2CH_3$(−1.63)

$—SO_2N(CH_3)_2$(−0.78) $—OCH_2CONH_2$(−1.37)

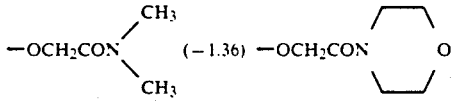

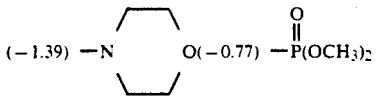

(−1.18) $—\overset{-}{N}(CH_3)_3$(−5.96) $—C(=O)NHOH$ (−1.87)

In formula (Z-5), e' represents an integer of 0 to 5 and preferably 1 to 3.

Specific examples of the group represented by formula (Z-1) are illustrated below:

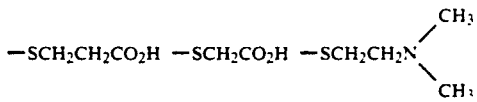

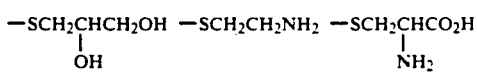

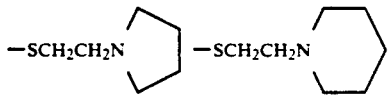

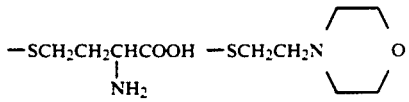

-continued $-SCH_2CH_2NHCH_3$ $-SCH_2CH_2NHSO_2CH_3$ $-SCH_2CH_2NHCOOCH_3$ $-SCH_2CH_2\overset{O}{\overset{\|}{P}}(ONa)_2$ $-SCH_2CH_2O\overset{O}{\overset{\|}{P}}(ONa)_2$ $-SCH_2CH_2OH$ $-SCH_2CH_2SO_2CH_3$ $-SCH_2CH_2CH_2SO_3Na$ $-SCH_2CH_2SO_2NH_2$ $-SCH_2CH_2N(C_2H_5)_2$ $-S(CH_2)_3COOH$ $-S\overset{CH_3}{\overset{|}{C}}HCOOH$ $-SCH_2\overset{CH_3}{\overset{|}{C}}HCOOH$ $-SCH_2CH_2SO_3K$ $-S(CH_2)_3N(CH_3)_2$ $-SCH_2CH_2S(=NH)NH_2$ $-SCH_2CH_2CH_2OH$ $-SCH_2CH_2N(C_3H_7(i))_2$ Specific examples of the group represented by formula (Z-2) are illustrated below:

$-SCH_2CH_2SCH_2CH_2OH$ $-SCH_2CH_2SCH_2COOH$ $-SCH_2CH_2SCH_2CH_2COOH$ $-SCH_2CH_2SCH_2CH_2N(CH_3)_2$ $-SCH_2CH_2OCH_2CH_2OH$ $-SCH_2CH_2OCH_2CH_2OH$ $-SCH_2CH_2OCH_2CH_2OH$ $-SCH_2CH_2\overset{O}{\overset{\|}{C}}CH_2OH$ $-SCH_2CONHCH_2COOH$ $-S(CH_2CH_2O)_3OH$ $-SCH_2CH_2N(CH_2COOH)_2$ $-SCH_2CH_2SO_2CH_2COOH$ Specific examples of the group represented by formula (Z-3) are illustrated below:

$-OCH_2CH_2SCH_2CH_2N(CH_3)_2$ $-O(CH_2CH_2S)_2CH_2CH_2N(CH_3)_2$ $-NH(CH_2CH_2S)_3CH_2CH_2OH$ $-S(CH_2CH_2S)_2CH_2CH_2OH$

-continued

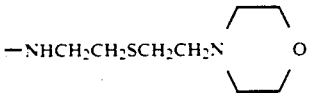

$-OCH_2CH_2N(CH_3)CH_2CH_2SCH_2CH_2N(CH_3)_2$ $-OCH_2CH_2N(CH_3)CH_2CH_2SCH_2CH_2OH$ $-OCH_2CH_2N(CH_3)(CH_2CH_2S)_2CH_2CH_2N(CH_3)_2$ $-NH(CH_2CH_2S)_3CH_2CH_2NH_2$ $-SCH_2CH_2SCH_2CH(OH)CH_2SCH_2CH_2$

Specific examples of the group represented by formula (Z-4) are illustrated below:

$-O\overset{O}{\overset{\|}{C}}CH(NH_2)CH_2SSCH_2CH(NH_2)CO_2H$ $-NHCH_2CH_2N(CH_3)CH_2CH_2SSCH_2CH_2N(CH_3)_2$ $-OCH_2CH_2SSCH_2CH_2N(CH_3)_2$ $-OCH_2CH_2SSCH_2CH_2COOH$ $-NHCH_2CH_2SSCH_2CH_2N(CH_3)_2$ $-SCH_2CH_2SSCH_2CH_2OH$ Specific examples of the group represented by formula (Z-5) are illustrated below:

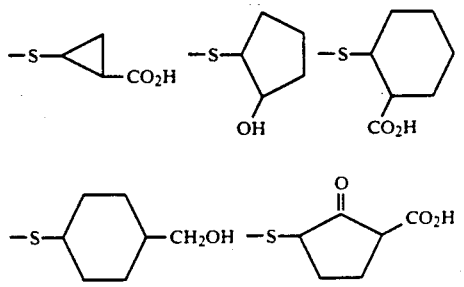

-continued
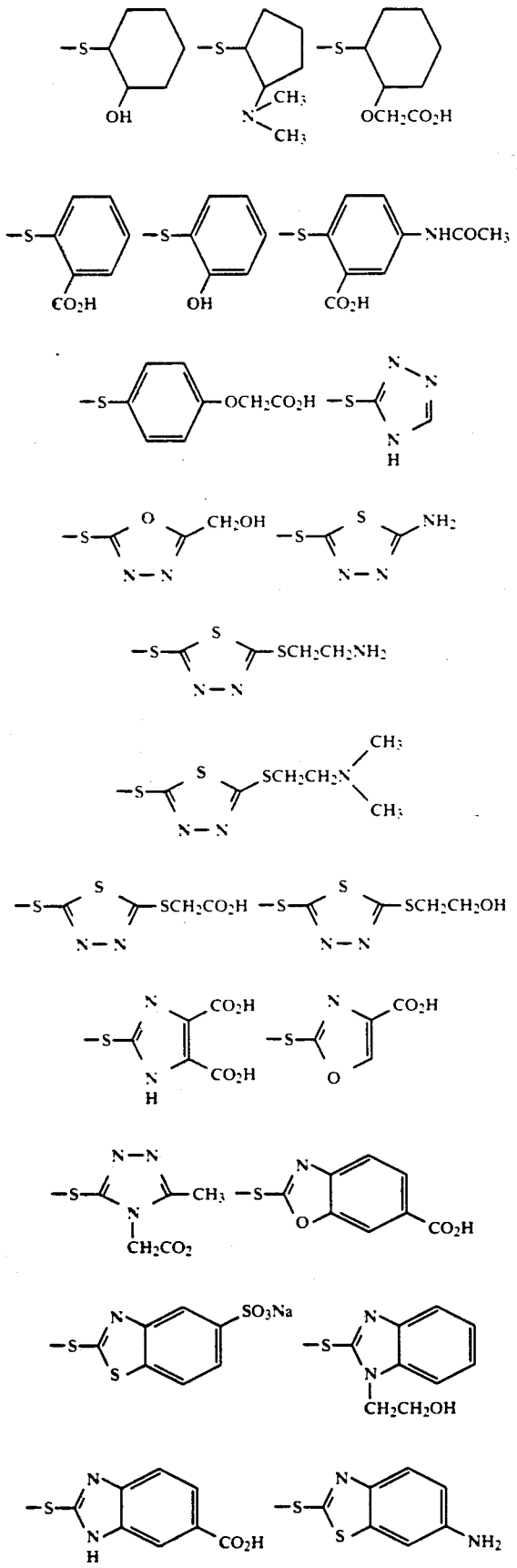
-continued
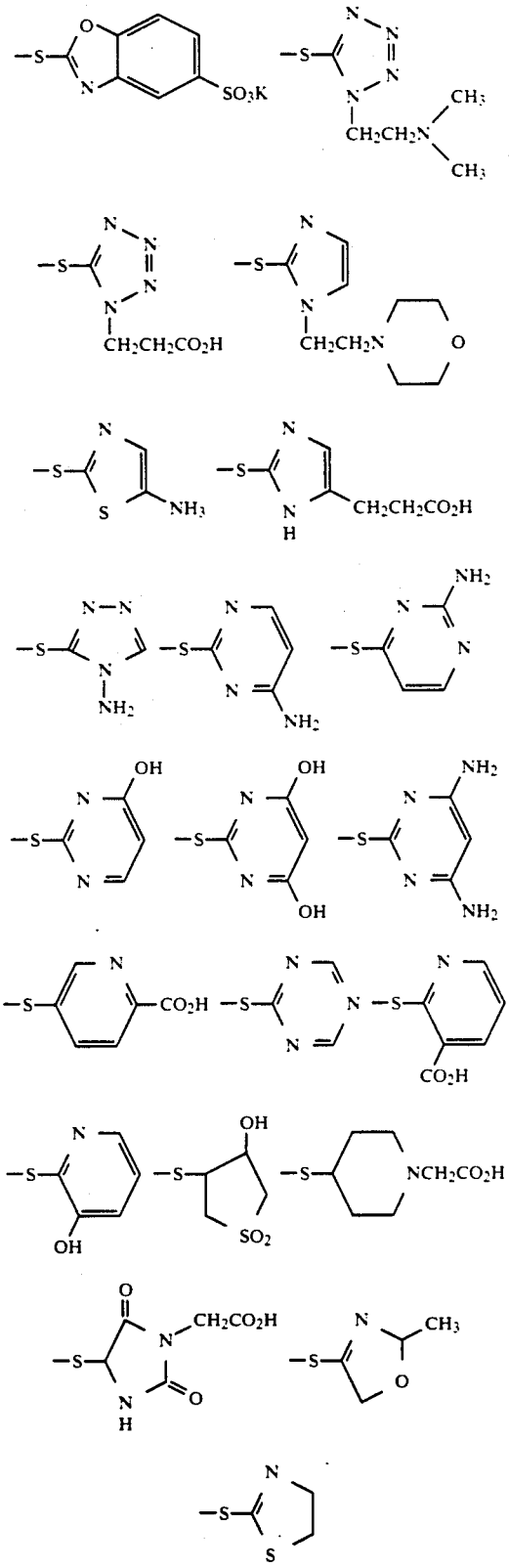
Of the groups represented by formula (Z-5l), those wherein $L_6$ represents a heterocyclic group are preferable.
In the compounds represented by formula (I). A preferably represents a coupler residue, $T_1$, $T_2$ and B are preferably not used, and Z preferably represents a group represented by formula (Z-1), (Z-2) or (Z-5), with (Z-1) being more preferable.
Specific examples of the bleaching accelerator-releasing compounds are illustrated below which, however, do not limit the present invention in any way.
(B-1)
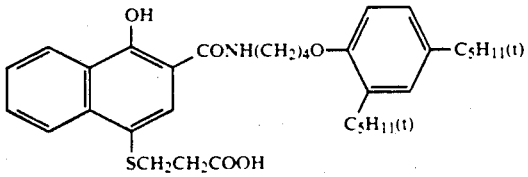
(B-2)
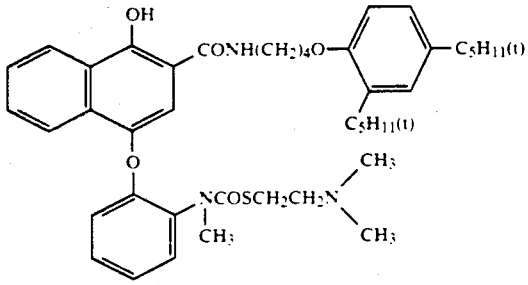
(B-3)
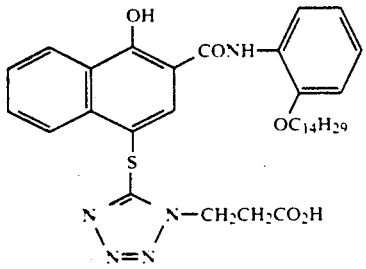
(B-4)
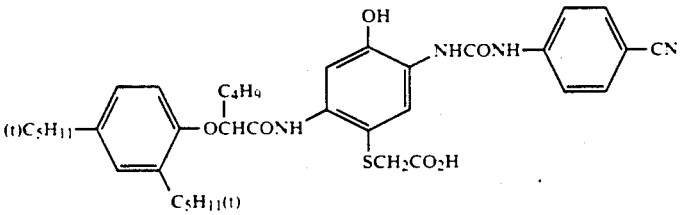
(B-5)
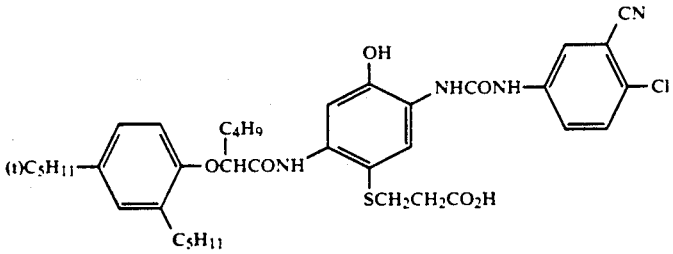
(B-6)
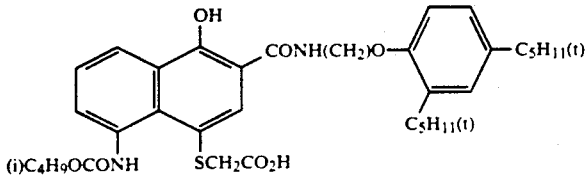

-continued
(B-7)
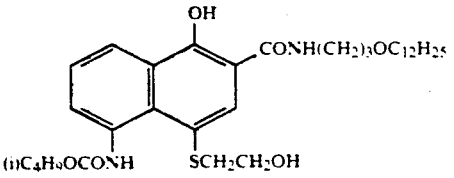
(B-8)
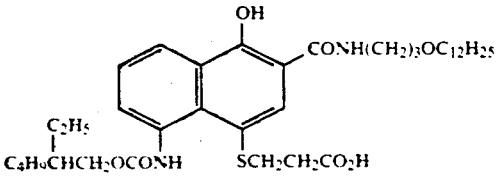
(B-9)
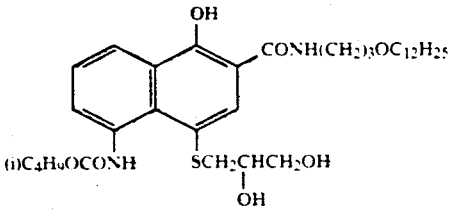
(B-10)
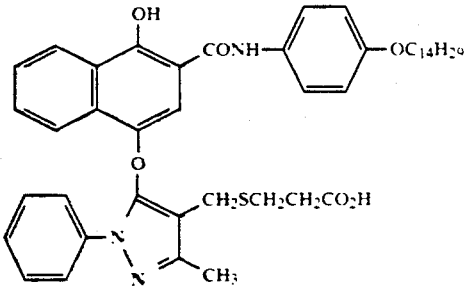
(B-11)
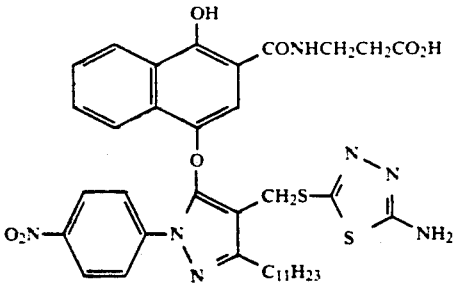
(B-12)
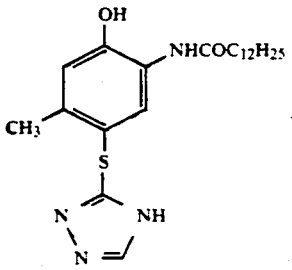

-continued
(B-13)
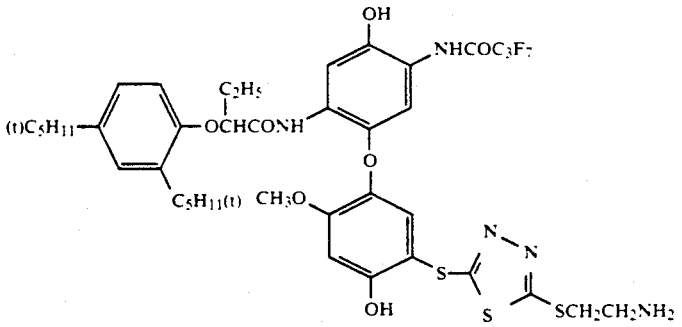
(B-14)
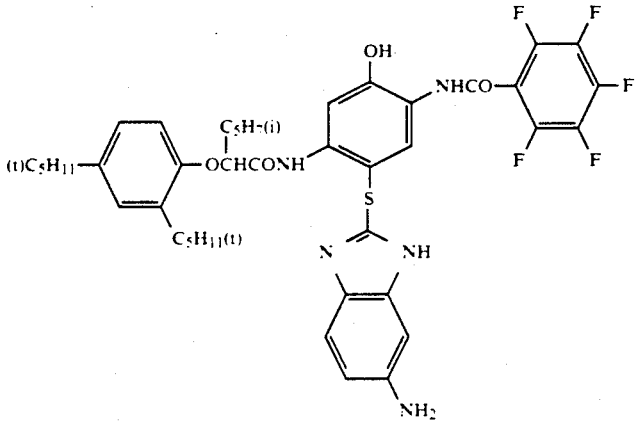
(B-15)
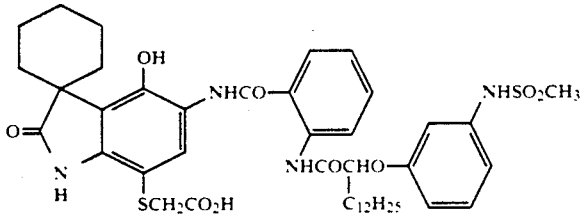
(B-16)
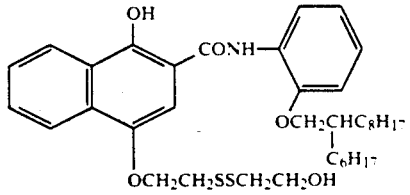
(B-17)
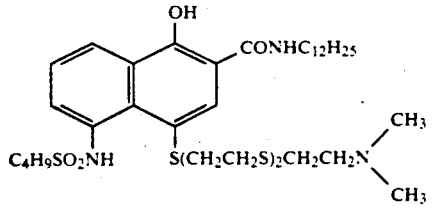
(B-18)
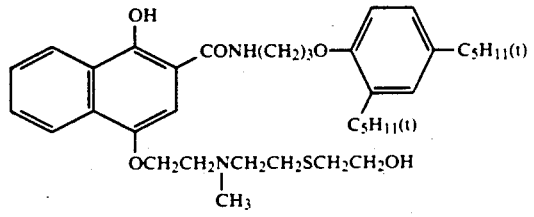

-continued
(B-19)
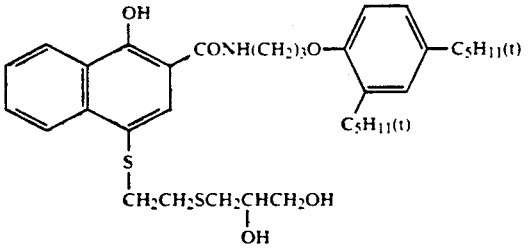
(B-20)
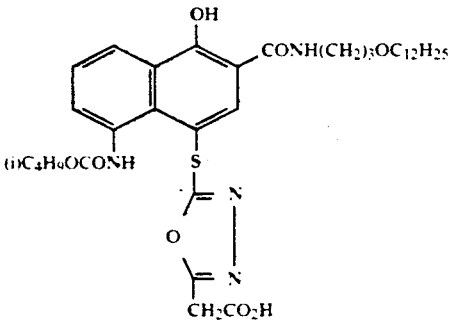
(B-21)
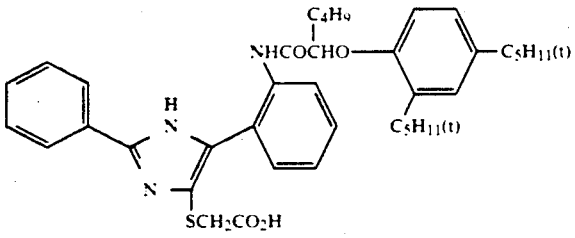
(B-22)
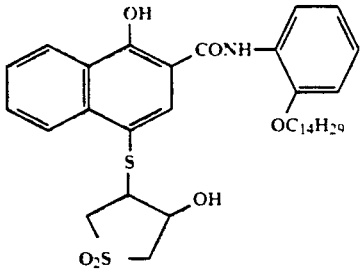
(B-23)
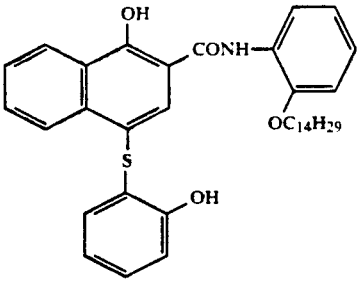
(B-24)
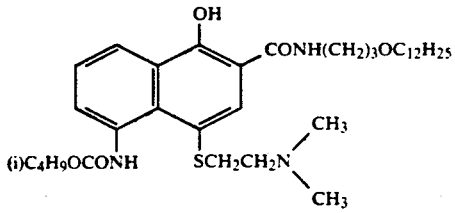

-continued
(B-25)
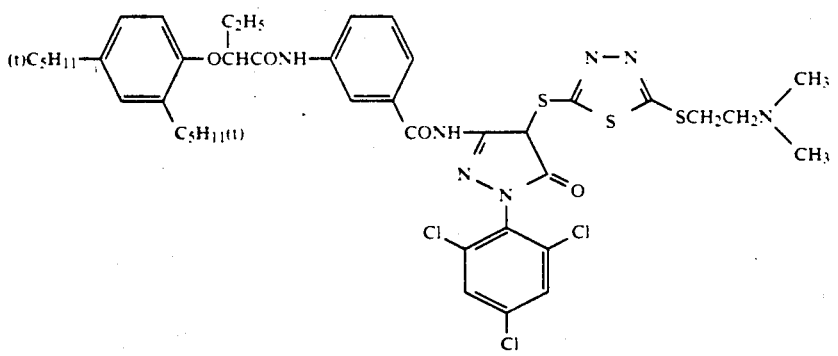
(B-26)
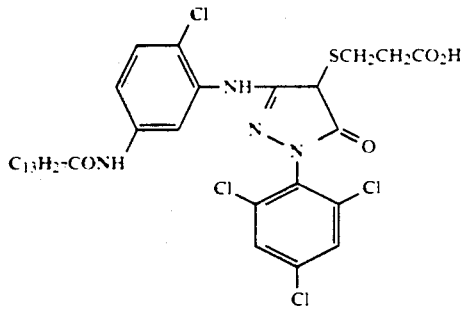
(B-27)
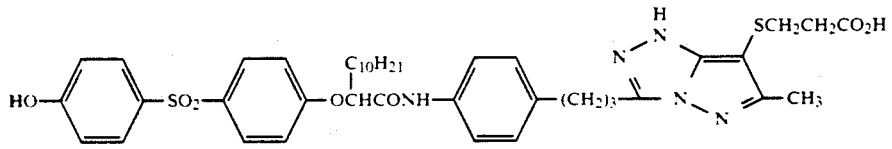
(B-28)
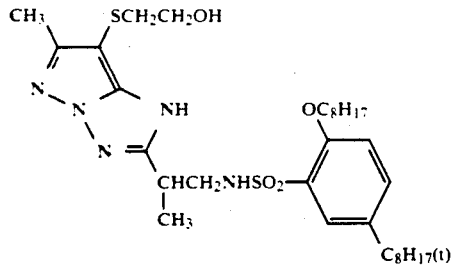
(B-29)
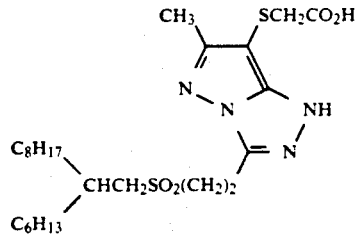

-continued
(B-30)
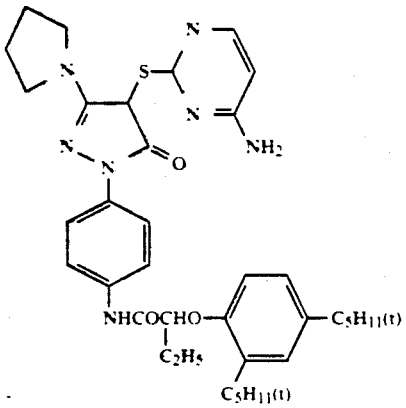
(B-31)
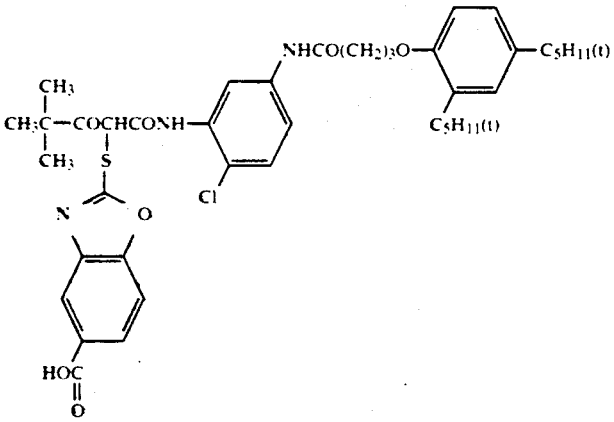
(B-32)
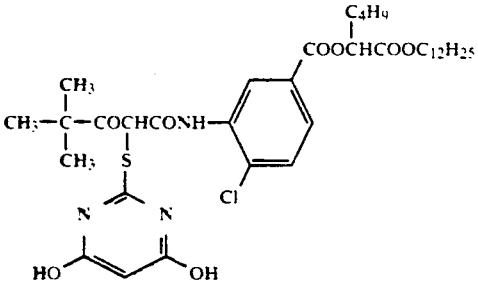
(B-33)
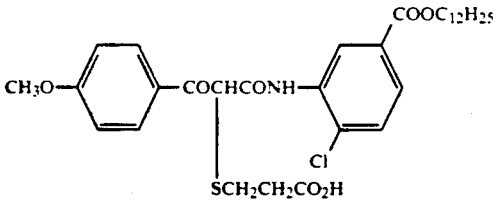
(B-34)
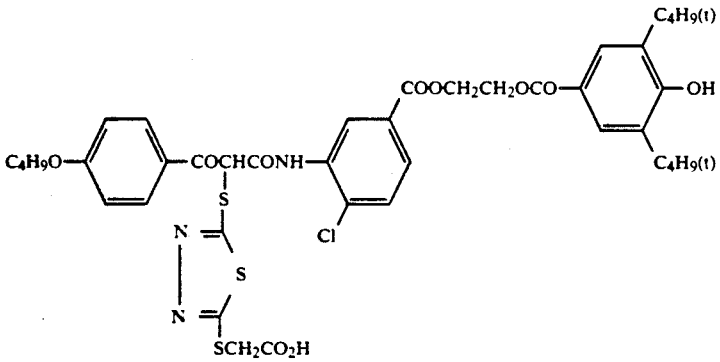

-continued
(B-35)
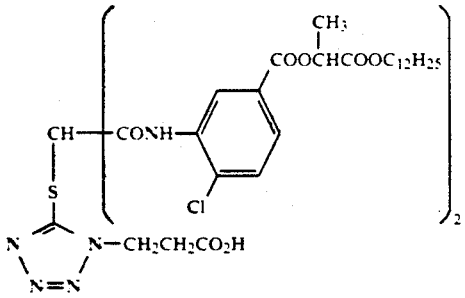
(B-36)
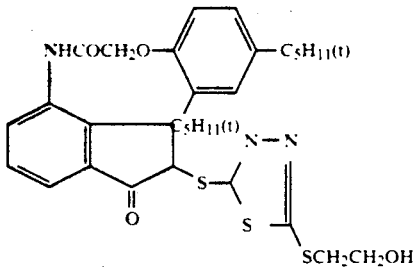
(B-37)
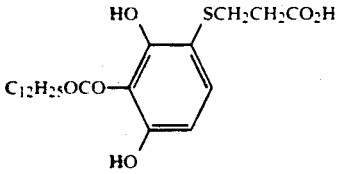
(B-38)
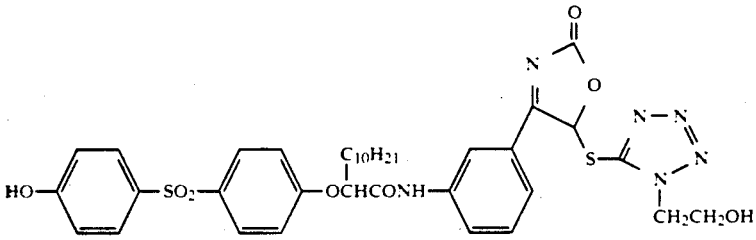
(B-39)
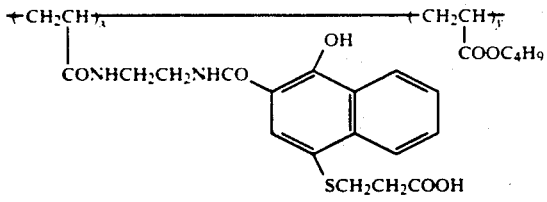
x/y = 50/50 (by weight)
(B-40)
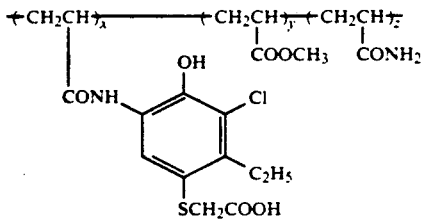
x/y/z = 50/25/25
(by weight)

-continued (B-41)

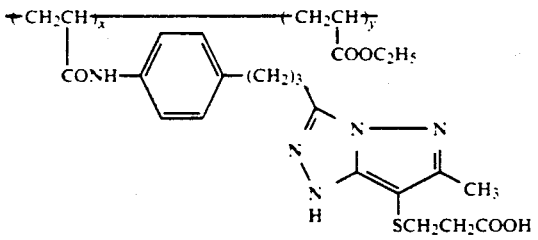

x/y = 45/55
(by weight)

(B-42)

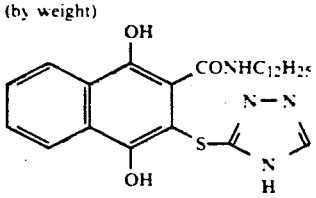

(B-43)

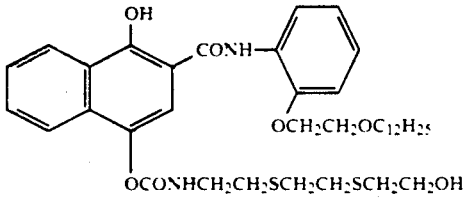

(B-44)

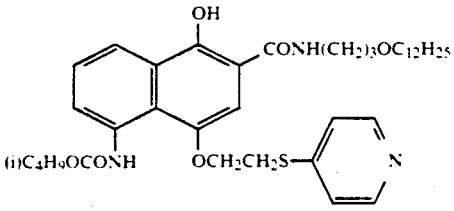

(B-45)

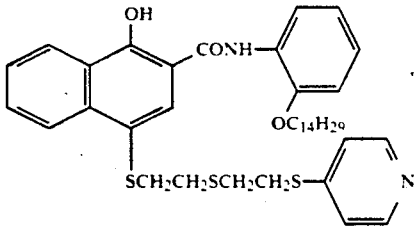

The aforementioned bleaching accelerator-releasing compounds to be used in the present invention can be synthesized according to processes described in, for example, EP-A-193329A$_2$, JP-A-62l-173467, JP-A-62-247363, 1 JP-A-63l-106749, JP-A-63l-121843, JP-A-63-121844, JP-A-63-121845, JP-A-63-214752, JP-A-63l-254452 and Japanese patent application No. 62-186939. In addition, those compounds which are described in Research Disclosure Nos. 24241 and 11449, JP-A-61-201247, JP-A-63-106749, JP-A-63-121843, and JP-A-63-121844 may similarly be used.

The bleaching accelerator-releasing compounds to be used in the present invention can easily be synthesized based on the descriptions of the above-mentioned patent specifications.

The bleaching accelerator-releasing compound of the present invention is added to a light-sensitive material in an amount of preferably from $1\times10^{-7}$ mol to $1\times10^{-1}$ mol and particularly preferably from $1\times10^{-6}$ to $5\times10^{-2}$ mol, per m$^2$ of the light-sensitive material. The bleaching accelerator-releasing compound in accordance with the present invention may be added to any layer of the light-sensitive material, but is preferably added to light-sensitive emulsion layers, and addition of the compound to more light-sensitive emulsion layers serves to provide more remarkable effects.

Processing bath having the bleaching ability of the present invention is described below.

In the present invention, light-sensitive materials are to be processed in a processing bath having bleaching ability immediately after color development.

The processing bath having bleaching ability generally means a bleaching solution and a fixing solution but, in the present invention, a bleaching solution is preferable in the point of excellent bleaching power. The silver-removing step (i.e., desilvering step) of the present invention includes, for example, the following steps which, however, are not limitative at all.

(1) Bleaching - Fixing
(2) Bleaching - Bleach-fixing
(3) Bleach-fixing
(4) Bleach-fixing - bleach-fixing (5) Bleaching - Washing with water - Fixing Steps (1) (Bleaching-Fixing) and Step (2) (Bleaching - Bleach-fixing) are particularly preferable for obtaining the advantage of the present invention.

As the bleaching agent of the present invention, at least one of ferric complex salt of the compounds selected from the foregoing compound groups (A) and iron (III) 1,3-diaminopropanetetraacetate complex salt (i.e., ferric complex salt of 1,3-diaminopropanetetraacetic acid) are used in combination in such proportion that molar ratio of the former to the latter is 3 or less (including 0), with the molar ratio of from 1.8 to 0.5 being preferable. If the molar ratio exceeds 3, the bleaching power is decreased to cause insufficient silver removal. If the content of iron (III) 1,3-diamiopropanetetraacetate complex salt is increased too much, slight bleaching fog may take place in some cases.

In step (2), the bleaching agent added to the bleach-fixing is preferably at least one of ferric complex salts of the compounds selected from the foregoing compound group (A).

The amount of the bleaching agent (i.e., the ferric complex salt of a compound selected from the compound group (A) and the ferric complex salt of 1,3-diaminopropanetetraacetic acid) of the present invention is from 0.05 mol to 1 mol and preferably from 0.1 mol to 0.5 mol, per liter of the bath having bleaching ability.

In addition to the above-described iron (III) aminopolycarboxylate complex salts, aminopolycarboxylates may be added to the processing solution of the present invention having the bleaching ability. In particular, addition of the compound of the compound group (A) is preferable.

Such compound is added in an amount of preferably from 0.0001 mol to 0.1 mol and more preferably from 0.003 mol to 0.05 mol, per liter of the processing solution.

The aminopolycarboxylic acids and their ferric complex salts are preferably used in the form of alkali metal salts or ammonium salts, with ammonium salts being particularly preferable in the point of excellent solubility and bleaching power.

In addition, the bleaching solution or bleach-fixing solution containing the above-described ferric ion complex salt may further contain complex salts of metal ions other than iron ion such as cobalt or copper ion.

Addition of various bleaching accelerators to the bath of the present invention having the bleaching ability is particularly preferred since the advantage of the present invention is increased.

As such bleaching accelerators, there may be used mercapto group- or disulfido group-containing compounds described in US Patent 3,893,858, German Patent 1,290,812, British Patent 1,138,842, JP-A-53-95630 and Research Disclosure, No. 17129 (July, 1978), thiazolidine derivatives described in JP-A-50-140129, thiourea derivatives described in U.S. Pat. No. 3,706,561, iodides described in JP-A-58-16235, polyethylene oxides described in German Patent 2,748,430 and polyamine compounds described in JP-B-45-8836. Of these, mercapto compounds as described in British patent 1,138,842 are particularly preferred.

In the present invention, bleaching accelerators represented by the formulae (IA) to (VIA) may be preferably used in the point of excellent bleaching ability and less bleaching fog.

Formula (IA):

$$A^{1A}-S-M^{1A}$$

In the above formula, $M^{1A}$ represents a hydrogen atom, an alkali metal atom, or ammonium, and $R^{1A}$ represents an alkyl group, an alkylene group, an aryl group or a heterocyclic residue. The alkyl group contains preferably from 1 to 5 carbon atoms and more preferably 1 to 3 carbon atoms. The alkylene group contains preferably 2 to 5 carbon atoms. As the aryl group, there are illustrated a phenyl group and a naphthyl group, with a phenyl group being particularly preferable. As the heterocyclic residue, nitrogen-containing 6-membered rings such as pyridine and triazine and nitrogen-containing 5-membered rings such as azole, pyrazole, triazole and thiadiazole are preferred, with those which contain two or more nitrogen atoms as ring-forming atoms being particularly preferable.

$R^{1A}$ may optionally be further substituted by a substituent or substituents. As such substituents, there are illustrated an alkyl group, an alkylene group, an alkoxy group, an aryl group, a carboxy group, a sulfo group, an amino group, an alkylamino group, a dialkylamino group, a hydroxy group, a carbamoyl group, a sulfamoyl group, and a sulfonamido group.

Of those represented by formula (1A), compounds represented by formulae (1A-1) to (1A-4) are preferable.

Formula (1A-1):

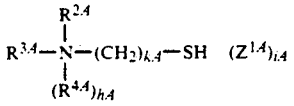

In the above formula, $R^{2A}$, $R^{3A}$ and $R^{4A}$, which may be the same or different, each represents a hydrogen atom, a substituted or unsubstituted lower alkyl group (containing preferably 1 to 5 carbon atoms; methyl, ethyl or propyl being particularly preferable) or an acyl group (containing preferably 1 to 3 carbon atoms; for example, acetyl or propionyl), kA represents an integer of 1 to 3, $Z^{1A}$ represents an anion (for example, chloride ion, bromide ion, nitrate ion, sulfate ion, p-toluenesulfonate ion or oxalate ion), hA represents 0 or 1, and iA represents 0 or 1.

$R^{2A}$ and $R^{3A}$ may be bound to each other to form a ring. $R^{2A}$, $R^{3A}$ and $R^{4A}$ each preferably represents a hydrogen atom or a substituted or unsubstituted lower alkyl group.

As substituents in which $R^{2A}$, $R^{3A}$ and $R^{4A}$ may have, a hydroxy group, a carboxy group, a sulfo group, an amino group, etc. are preferred.

Formula (1A-2)

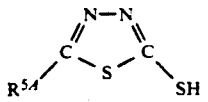

Formula (1A-3)

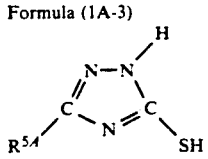

Formula (1A-4)

-continued

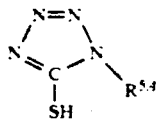

In the above formulae, $R^{5A}$ represents a hydrogen atom, a halogen atom (e.g., chlorine or bromine), an amino group, a substituted or unsubstituted lower alkyl group (containing preferably 1 to 5 carbon atoms; methyl, ethyl or propyl being particularly preferable), an amino group having an alkyl group (e.g., methylamino, ethylamino, dimethylamino or diethylamino), or a substituted or unsubstituted alkylthio group.

As substituents $R^{5A}$ may have, there are illustrated a hydroxy group, a carboxy group, a sulfo group, an amino group, amino group having an alkyl group, etc.

Formula (IIA)

$$R^{1A}-S-S-R^{6A}$$

In the above formula, $R^{1A}$ is the same as defined for $R^{1A}$ in formula (1A), $R^{6A}$ is the same as defined for $R^{1A}$, and $R^{1A}$ and $R^{6A}$ may be the same or different.

Of those represented by formula (IIA), compounds represented by formula (IIA-1) are preferred.

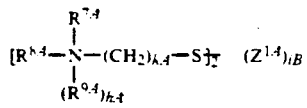

wherein $R^{7A}$, $R^{8A}$ and $R^{9A}$ are the same as defined for $R^{2A}$, $R^{3A}$ and $R^{4A}$, respectively, hA, kA and $Z^{1A}$ are the same as defined for hA, kA and $Z^{1A}$ in formula (1A-1), and iB represents 0, 1 or 2.

Formula (III):

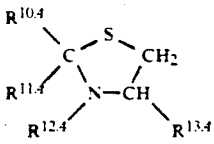

wherein $R^{10A}$ and $R^{11A}$, which may be the same or different, each represents a hydrogen atom, an optionally substituted alkyl group (preferably a lower alkyl group such as methyl, ethyl or propyl), an optionally substituted phenyl group or an optionally substituted heterocyclic group (more specifically, a heterocyclic group containing at least one hetero atom (e.g., nitrogen atom, oxygen atom or sulfur atom), such as a pyridine ring, a thiophene ring, a thiazolidine ring, a benzoxazole ring, a benzotriazole ring, a thiazole ring, or imidazole ring), and $R^{12A}$ represents a hydrogen atom or an optionally substituted lower alkyl group (for example, methyl or ethyl; containing preferably 1 to 3 carbon atoms).

As substituents which $R^{10A}$ to $R^{12A}$ may have, there are illustrated a hydroxy group, a carboxy group, a sulfo group, an amino group, a lower alkyl group, etc.

$R^{13A}$ represents a hydrogen atom, an alkyl group or a carboxy group.

Formula (IVA):

-continued

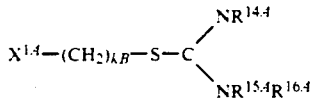

In the above formula $R^{14A}$, $R^{15A}$ and $R^{16A}$, which may be the same or different, each represents a hydrogen atom or a lower alkyl group (e.g., methyl or ethyl; containing preferably from 1 to 3 carbon atoms), kB represents an integer of from 1 to 5.

$X^{1A}$ represents an optionally substituted amino group, a sulfo group, a hydroxy group, a carboxy group or a hydrogen atom. As substituents, there are substituted or unsubstituted alkyl groups (for example, methyl, ethyl, hydroxyalkyl, alkoxyalkyl or carboxyalkyl), with two alkyl groups optionally forming ring.

$R^{14A}$, $R^{15A}$ and $R^{16A}$ may be bound to each other to form a ring. As $R^{14A}$ to $R^{16A}$, a hydrogen atom, a methyl group or an ethyl group is preferred and, as $X^{1A}$, an amino group or a dialkylamino group is preferred.

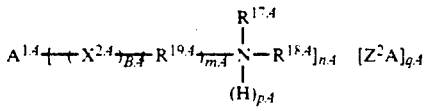

In the above formula, $A^{1A}$ represents an n-valent aliphatic linking group, aromatic linking group or heterocyclic linking group (when n=1, $A^{1A}$ merely represents an aliphatic group, an aromatic group or a heterocyclic group).

As the aliphatic linking group represented by $A^{1A}$, there are illustrated alkylene groups containing 3 to 12 carbon atoms (e.g., trimethylene, hexamethylene or cyclohexylene).

As the aromatic linking group, there are illustrated arylene groups containing 6 to 18 carbon atoms (e.g., phenylene or naphthylene).

As the heterocyclic linking group, there are illustrated heterocyclic groups containing one or more hetero atoms (e.g., oxygen, sulfur or nitrogen) such as thiophene, furan, triazine, pyridine and piperidine.

The aliphatic linking group, aromatic linking group and heterocyclic linking group are usually used in a single form, but two or more of them may be bound to each other directly or via a divalent linking group (for example, —O—, —S—,

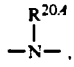

—SO—, —CO— or a linking group formed by these linking groups, wherein $R^{20A}$ represents a lower alkyl group).

The aliphatic linking group, aromatic linking group and heterocyclic linking group may have a substituent or substituents.

As such substituents, there are illustrated an alkoxy group, a halogen atom, an alkyl group, a hydroxy group, a carboxy group, a sulfo group, a sulfonamide group and a sulfamoyl group.

$X^{2A}$ represents —O—, —S—,

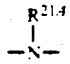

(wherein $R^{21A}$ represents a lower alkyl group (e.g., methyl or ethyl), $R^{17A}$ and $R^{18A}$ each represents a substituted or unsubstituted lower alkyl group (e.g., methyl, ethyl, propyl, isopropyl or pentyl). As the substituents, a hydroxy group, a lower alkoxy group (e.g., methoxy, methoxyethoxy or hydroxyethoxy), an amino group (e.g., unsubstituted amino, dimethylamino, N-hydroxyethyl-N-methylamino, etc.) are preferred. Where two or more substituents exist, they may be the same or different.

$R^{19A}$ represents a lower alkylene group containing 1 to 5 carbon atoms (e.g., methylene, ethylene, trimethylene, or methylmethylene) and $Z^{2A}$ represents an anion (e.g., halide ion (e.g., chloride ion or bromide ion), nitrate ion, sulfate ion, p-toluenesulfonate ion or oxalate ion).

$R^{17A}$ and $R^{18A}$ may be bound to each other via a carbon atom or a hetero atom (e.g., oxygen, nitrogen or sulfur) to form a 5- or 6-membered hetero ring (e.g., a pyrrolidine ring, a piperidine ring, a morpholine ring, a triazine ring or an imidazolidine ring).

$R^{17A}$ (or and $A^{1A}$ may be bound to each other via a carbon atom or a hetero atom (e.g., oxygen, nitrogen or sulfur) to form a 5- or 6-membered hetero ring (e.g., a hydroxyquinoline ring, a hydroxyindole ring or an isoindoline ring).

$R^{17A}$ (or and $R^{19A}$ may be bound to each other via a carbon atom or a hetero atom (e.g., oxygen, nitrogen or sulfur) to form a 5- or 6-membered hetero ring (e.g., a piperidine ring, a pyrrolidine ring or a morpholine ring).

lA represents 0 or 1, mA represents 0 or 1, nA represents 1, 2 or 3, pA represents 0 or 1, and qA represents 0, 1, 2 or 3.

Formula (VIA):

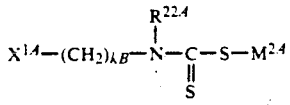

In the above formula, $X^{1A}$ and kB are the same as defined for $X^{1A}$ and kB in formula (IVA), respectively.

$M^{2A}$ represents a hydrogen atom, an alkali metal atom, an ammonium or

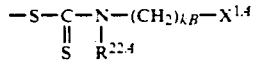

wherein $R^{22A}$ represents a hydrogen atom or a lower alkyl group (containing 1 to 5 carbon atoms and optionally having a substituent or substituents).

Specific examples of the compounds represented by formulae (IA) to (VIA) are illustrated below.

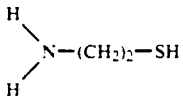

(1A)-(1)

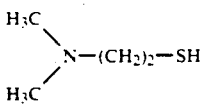

(1A)-(2)

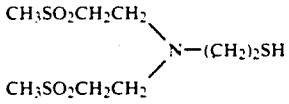

(1A)-(3)

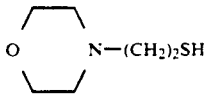

(1A)-(4)

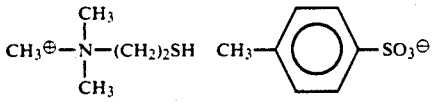

(1A)-(5)

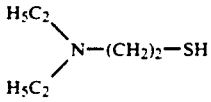

(1A)-(6)

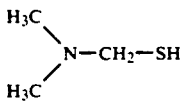

(1A)-(7)

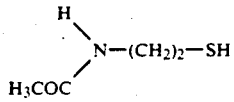

(1A)-(8)

-continued
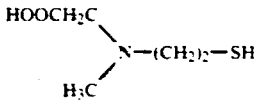
(1A)-(9)
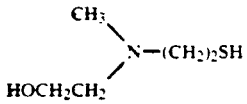
(1A)-(10)
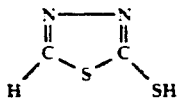
(1A)-(11)
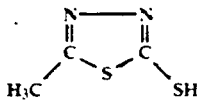
(1A)-(12)
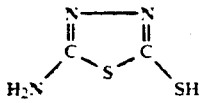
(1A)-(13)
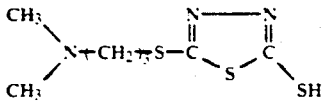
(1A)-(14)
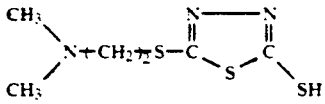
(1A)-(15)
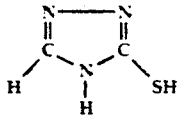
(1A)-(16)
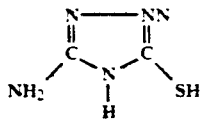
(1A)-(17)
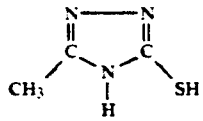
(1A)-(18)
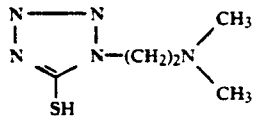
(1A)-(19)
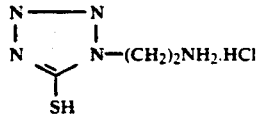
(1A)-(20)
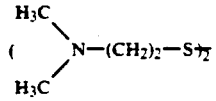
(IIA)-(1)

-continued
(IIA)-(2)
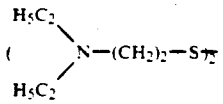
(IIA)-(3)
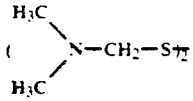
(IIA)-(4)
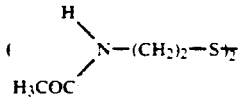
(IIA)-(5)
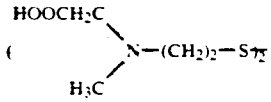
(IIA)-(6)
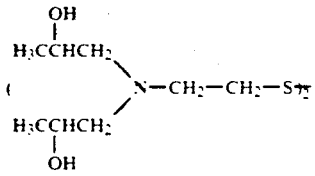
(IIA)-(7)
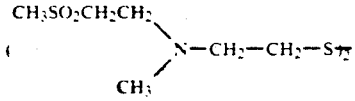
(IIA)-(8)
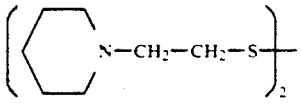
(IIA)-(9)
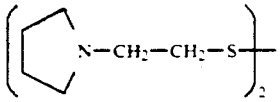
(IIA)-(10)
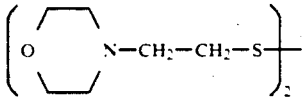
(IIA)-(11)
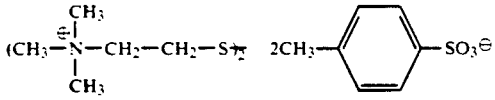
(IIA)-(12)
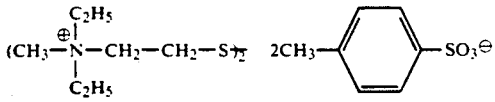
$(HOCH_2CH_2S\rightarrow_2$ (IIA)-(13)
$(HO_2CCH_2SCH_2CH_2S\rightarrow_2$ (IIA)-(14)
$(HOCH_2CH(OH)CH_2S\rightarrow_2$ (IIA)-(15)
$(HOCH_2C(=O)CH_2CH_2S\rightarrow_2$ (IIA)-(16)

-continued
$(HO_3SCH_2CH_2CH_2S)_2$ (IIA)(17)
$(HOCH_2CH_2CH_2S)_2$ (IIA)-(18)
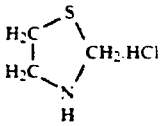
(IIIA)-(1)
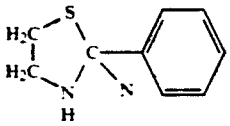
(IIIA)-(2)
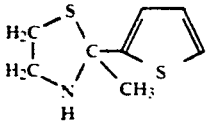
(IIIA)-(3)
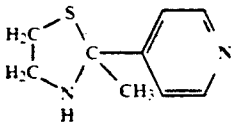
(IIIA)-(4)
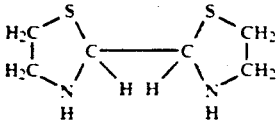
(IIIA)-(5)
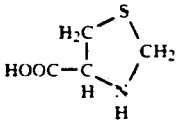
(IIIA)-(6)
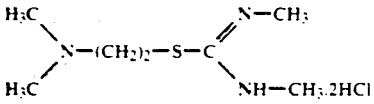
(IVA)-(1)
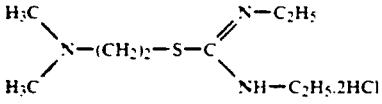
(IVA)-(2)
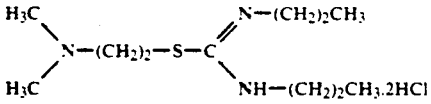
(IVA)-(3)
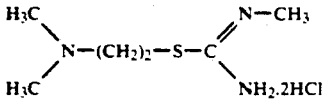
(IVA)-(4)
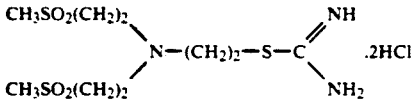
(IVA)-(5)
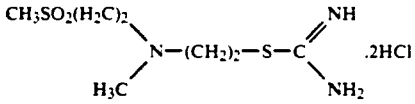
(IVA)-(6)

-continued
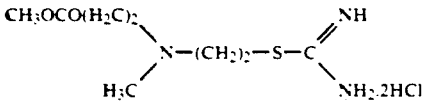
(IVA)-(7)
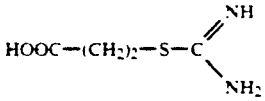
(IVA)-(8)
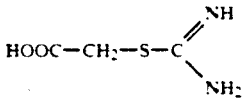
(IVA)-(9)
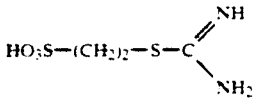
(IVA)-(10)
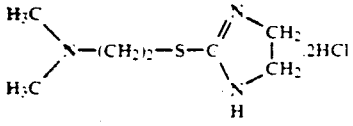
(IVA)-(11)
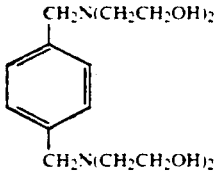
(VA)-(1)
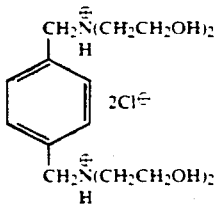
(VA)-(2)
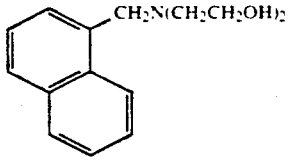
(VA)-(3)
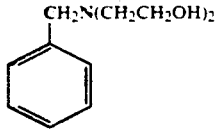
(VA)-(4)
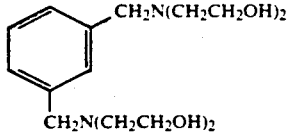
(VA)-(5)
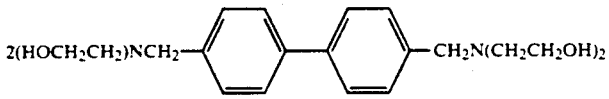
(VA)-(6)

-continued
(VA)-(7)
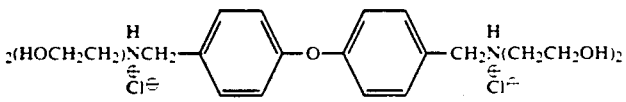
(VA)-(8)
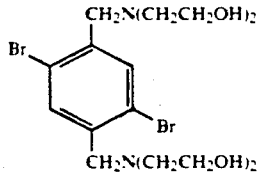
(VA)-(9)
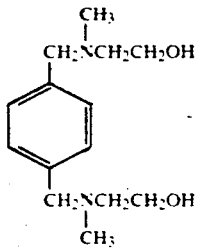
(VA)-(10)
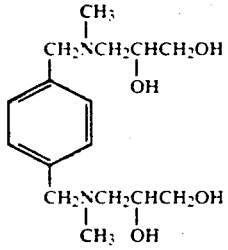
(VA)-(11)
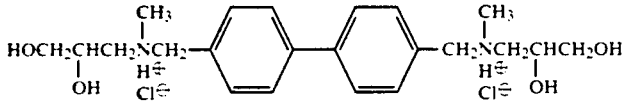
(VA)-(12)
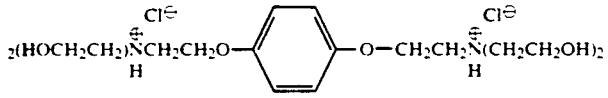
(VA)-(13)
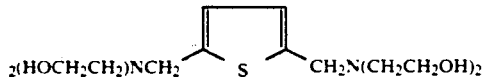
(VA)-(14)
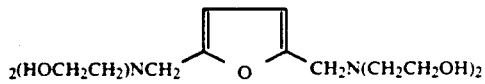
(VA)-(15)
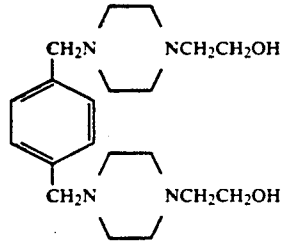

-continued
(VA)-(16)
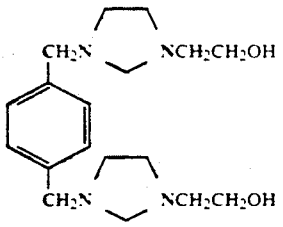
(VA)-(17)
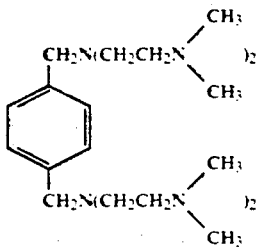
(VA)-(18)
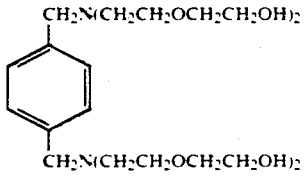
(VA)-(19)
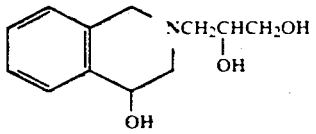
(VA)-(20)
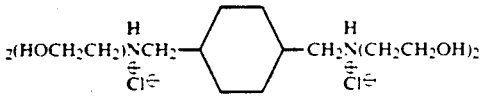
(VA)-(21)
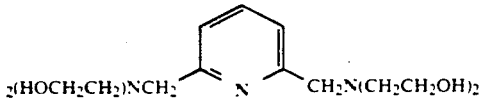
(VA)-(22)
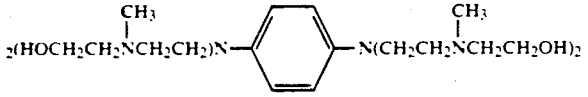
(VA)-(23)
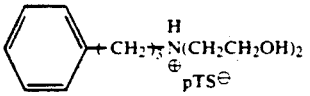
(VA)-(24)
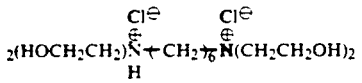
(VA)-(25)
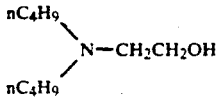
(VA)-(26)
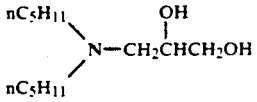

-continued

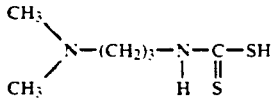

(VIA)-(1)

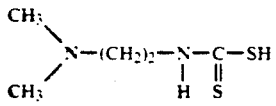

(VIA)-(2)

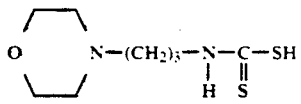

(VIA)-(3)

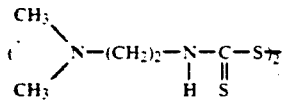

(VIA)-(4)

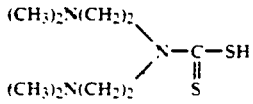

(VIA)-(5)

In addition to the above-described compounds, the following compounds may also be preferably used as bleaching accelerators.

$HOCH_2CH_2SH$ $HO_2CCH_2SCH_2CH_2SH$ $HOCH_2CH_2SH$ $HO_2CCH_2SCH_2CH_2SH$ $HOCH_2CH(OH)CH_2SH$ $HOCH_2C(=O)CH_2CH_2SH$ $HO_3SCH_2CH_2CH_2SH$ $HOCH_2CH_2CH_2SH$ $HO_3SCH_2CH_2CH_2SH$ $HOCH_2CH_2CH_2SH$

Of the above-described bleaching accelerators, IA-2, IA-5, IA-13, IA-14, IA-15, IA-16, IA-19, IIA-1, IIA-11, VA-1, VIA-1 and VIA-2 are particularly preferred. The bleaching accelerators are added in amounts of generally from 0.01 g to 20 g and preferably from 0.1 g to 10 g, per liter of the solution having bleaching ability.

In addition to the bleaching agent and the bleach accelerating compounds described above, the bleaching solution according to the present invention can contain rehalogenating agents, for example, bromides such as potassium bromide, sodium bromide and ammonium bromide and chlorides such as potassium chloride, sodium chloride and ammonium chloride. The amount of the rehalogenating agent is generally from 0.1 to 5 mol, preferably from 0.5 to 3 mol per liter of the bleaching solution.

Further, other additives that have a pH buffering ability and are known to be used generally in a bleaching solution can be employed. For example, one or more inorganic acids, organic acids and their salts such as nitrates (e.g., sodium nitrate and ammonium nitrate), boric acid, borax, sodium metaborate, acetic acid, sodium acetate, sodium carbonate, potassium carbonate, phosphorous acid, phosphoric acid, sodium phosphate, citric acid, sodium citrate and tartaric acid can be added to the solution.

The pH value of the bath of the present invention having a bleaching ability is normally in the range of 1 to 6, preferably 1.5 to 5.8, and particularly 2 to 5.3. In the preferred pH range, the processing bath causes little bleach fog and exhibits an excellent desilvering property.

The replenished amount of the present processing solution having a bleaching ability is in the range of 50 to 2,000 ml, preferably 100 to 1,000 ml per 1 $m^2$ of the light-sensitive material.

In the present invention, the light-sensitive material which has been processed in a bath having a bleaching ability is normally processed in a bath having a fixing ability. However, this does not apply to the case where the bath having a bleaching ability is a blixing solution (bleach fixing solution).

The term "bath having a fixing ability" as used herein means a blix bath or fixing bath.

Further, in the bleach-fixing solution, thiosulfates such as sodium thiosulfate, ammonium thiosulfate, sodium ammonium thiosulfate and potassium thiosulfate; thiocyanates such as sodium thiocyanate, ammonium thiocyanate and potassium thiocyanate; thiourea; and thioethers are employed as fixing agents. The amount of the fixing agents used is generally from 0.3 to 3 mol and preferably from 0.5 to 2 mol, per liter of the bleach-fixing solution.

The bleach-fixing bath can contain preservatives such as sulfites (e.g., sodium sulfite, potassium sulfite and ammonium sulfite), hydroxylamines, hydrazines and aldehyde compound-bisulfite adducts (e.g., acetaldehydesodium bisulfite adduct). Further, various fluorescent brightening agents, deforming agents, surface active agents, polyvinyl pyrrolidone, and organic solvents (e.g., methanol) may be added to the bleach-fixing bath.

As such a preservative there may be preferably used a sulfinic acid compound as described in JP-A-62-143048.

The amount of replenishment for the bleach-fixing bath is preferably from 300 to 3,000 ml and more preferably from 300 to 1,000 ml, per ml of the color light-sensitive material.

The present processing bath having a fixing ability may preferably comprise aminopolycarboxylic acids or organic phosphonic acids for the purpose of stabilizing the solution.

The shorter the total time of the present desilvering process (i.e., silver-removing step) is, the more remarkable is the effect of the present invention. The total time of desilvering process (i.e., silver-removing step) is preferably in the range of 1 to 4 minutes, particularly 1 minutes and 30 seconds to 3 minutes. The processing temperature is in the range of 25 to 50° C., preferably 35 to 45° C. In the preferred processing temperature range, the desilvering rate can be improved, and stain after processing can be effectively prevented.

In the present desilvering process, agitation is preferably intensified as much as possible to attain the effects o the present invention more effectively.

Specific examples of methods for intensifying agitation include method as described in JP-A-62-183,460, and 62-183,461 which comprises spraying a processing solution against the emulsion surface of a light-sensitive material, method as described in JP-A-62-183,461 which comprises using a rotating means to improve the agitating effect, method which comprises moving a light-sensitive material while keeping a wiper blade provided in the solution and the emulsion surface of the light-sensitive material in contact with each other to cause turbulence on the emulsion surface so that the agitating effect can be improved, and method which comprises increasing the circulating amount of the entire processing solution. Such an agitation improving means can be effectively used also in any of bleaching solution, blixing solution and fixing solution. It can be believed that the improvement of agitation expedites the supply of a bleaching agent, fixing agent and the like into the emulsion film, resulting in an improvement in the desilvering rate.

The above described agitation improving means can be more effectively used in the case where a bleach accelerator is used. The agitation improving means can drastically strengthen the bleach accelerating effect or eliminate the fixation inhibiting effect of the bleaching accelerator.

The automatic developing machine to be used in the present invention may preferably be provided with a light-sensitive material conveying means as described in JP-A-60-191,257, 60-191,257, 60-191,258, and 60-191,259. As described in JP-A-60-191,257, such a conveying means can drastically reduce the amount of a processing solution carried over from prebath, thus preventing the deterioration in the properties of the processing solution. Such an effect is particularly effective for the reduction of the processing time at each step or the reduction of the supply amount of each processing solution.

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4 4-[N-Ethyl-N-(8-hydroxyethyl)amino]aniline
D-5: 2-Methyl-4-[N-ethyl]-N-(8-hydroxyethyl-)amino]-aniline
D-6: 4-Amino-3-methyl-N-ethyl-N-[8-(methanesulfonamino)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-8-ethoxyethylaniline
D-11: 4-Amino-3-methyl-N-ethyl-N-8-butoxyethylaniline Of these p-phenylenediamine derivatives, D-5 is particularly preferred.

These p-phenylenediamine derivatives may be in the form of salts such as sulfates, hydrochlorides, sulfites, or p-toluenesulfonates.

The aromatic primary amine developing agent is preferably used in an amount of generally from about 0.1 g to about 20 g and more preferably from about 0.5 g to about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

The color developing solution contains the preservative in an amount of 0.5 g to 10 g and more preferably 1 g to 5 g per liter of the color developing solution.

Further, it is preferred to add, as compounds capable of directly preservating the color developing agent, various hydroxylamines, hydroxamic acids as described in JP-A-63-43138, hydrazines and hydrazides as described in European Patent 254280A, phenols as described in JP-A-63-44657 and JP-A-63-58443, α-hydroxyketones and α-aminoketones as described in JP-A-63-44656, and/or various saccharides as described in JP-A-63-36244 to the color developing solution. Moreover, together with the above described compounds, monoamines as described in JP-A-63-4235, JP-A-63-24254, JP-A-63-21647, JP-A-63-146040, JP-A-63-27841 and JP-A-63-25654; diamine as described in JP-A-63-30845, JP-A-63-146040 and JP-A-63-43139; polyamines as described in JP-A-63-21647 and JP-A-63-26655; polyamines as described in JP-A-63-44655, nitroxy radicals as described in JP-A-63-53551; alcohols as described in JP-A-63-43140 and JP-A-63-53549; oximes as described in JP-A-63-56654; and tertiary amines as described in European Patent 266,797 are preferably employed.

Other preservatives such as various metals as described in JP-A-57-44148 and JP-A-57-53749, silicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc. may be incorporated into the color developing solution, if desired. Particularly, the addition of aromatic polyhydroxy compounds is preferred.

The color developing solution used in the present invention has a pH which ranges preferably from 9 to 12 and more preferably from 9 to 11.0. The color developing solution may also contain any of the compounds that are known to be usable as components of conventional developing solutions.

In order to maintain the pH within the above-described range, various kinds of buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter of the developing solution.

In addition, various chelating agents can be used in the color developing solution according to the present invention for the purpose of preventing calcium or magnesium precipitation or increasing the stability of the color developing solution.

As the chelating agents, organic acid compounds are preferred and include aminopolycarboxylic acids, organic phosphoric acids and phosphonocarboxylic acids.

Specific examples of useful chelating agents are set forth below, but the present invention should not be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N'-tetramethylenephosphonoic acid
Trans-cyclohexanediaminetetraacetic acid
1,2-Diaminopropanetetraacetic acid
Hydroxyethyliminodiacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N-N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions being present therein. For example, a range of from about 0.1 g to about 10 g per liter of the color developing solution may be employed.

The color developing solution may contain appropriate development accelerators, if desired. However, it is preferred that the color developing solution used in the present invention does not substantially contain benzyl alcohol in view of prevention of environmental pollution, the easy preparation of the solution and prevention of color stain. The term "substantially not contain" means that the color developing solution contains benzyl alcohol in an amount of 2 ml or less per liter of the solution, and preferably does not contain benzyl alcohol at all.

Examples of suitable development accelerators include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926, and 3,582,346 and JP-B-41-11431; polyalkylene oxides as described in JP-B-37-16088, JP-B-42-25201, JP-B-41-11431, JP-B-42-23883 and U.S. Pat. Nos. 3,128,183 and 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethyl-benzimidazole, indazole, hydroxyazaindolizine and adenine, etc.

It is preferred that the color developing solution used in the present invention contains a fluorescent brightening agent. As fluorescent brightening agents, 4,4'-diamino-2,2'-disulfostilbene type compounds are preferred. The amount of the fluorescent brightening agent added is from 0 to 5 g and preferably from 0.1 g to 4 g, per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 20° C. to 50° C. and preferably from 30° C. to 45° C. The processing time is usually from 20 sec. to 5 min. and preferably from 30 sec. to 3 min. Further, the amount of replenishment for the color developing solution is preferably as small as feasible, and is usually from 100 ml to 1,500 ml, preferably from 100 ml to 800 ml, and more preferably from 100 ml to 400 ml, per square meter of the color light-sensitive material.

If required, the color developing bath may be divided into two or more baths, so that a color developing replenisher may be supplied from the first bath or the last bath to shorten the developing time or to reduce the amount of the replenisher.

The processing method according to the present invention can be used in a color reversal process. A suitable black-and-white developing solution used in this case includes a black-and-white first developing solution (used in reversal process of color photographic light-sensitive materials), or one that can be used in processing black-and-white photographic light-sensitive materials. Further, known various additives that are generally added to a black-and-white developing solution can be contained in the solution.

Representative additives include developing agents such as 1-phenyl-3-pyrazolidone, Metol ($HOC_6H_4NHCH_3 \cdot \frac{1}{2}H_2SO_4$) and hydroquinone; preservatives such as sulfites; accelerators comprising an alkali such as sodium hydroxide, sodium carbonate and potassium carbonate; inorganic or organic restrainers such as potassium bromide, 2-methylbenzimidazole and methylbenzothiazole; hard water softening agents such as polyphosphates; and development restrainers comprising trace amounts of iodides or mercapto compounds.

The processing method according to the present invention comprises processing steps including color development, bleaching, bleach-fixing, fixing etc., as mentioned above. After the bleach-fixing or fixing step, although processing steps that include water washing and stabilizing are generally carried out, a simple processing method, is also possible wherein after being processed in a bath having a fixing ability, a stabilizing process is carried out without performing substantial water washing.

The washing water used in the water washing step can contain, if desired, known additives. For example, hard water softening agents such as inorganic phosphoric acid, amino-polycarboxylic acids and organic phosphoric acids, antibacterial and antifungal agents for preventing various bacteria and algae from proliferating (e.g., isothiazolone, organic chlorine type disinfectants and benzotriazole) and surface active agents for lowering drying load or for preventing uneven drying can be used. Compounds described, for example, in L. E. West, "Water Quality Criteria", *Phot. Sci. and Eng.*, Vol. 9, No. 6, pages 344 to 359 (1965) can also be used.

A suitable stabilizing solution used in the stabilizing step includes a processing solution for stabilizing dye images. For example, a solution having a pH of from 3 to 6 and a buffering ability and a solution containing an aldehyde (e.g., formalin) can be used. The stabilizing solution can contain, if desired, ammonium compounds, compounds containing metals such as Bi and Al, fluorescent brightening agents, chelating agents (e.g., 1-hydroxy-ethylidene-1,1-diphosphonic acid), antibacterial, antifungal agents, hardening agents, surface active agents, etc.

It is preferred to employ a multistage counter-current system in the water washing step or stabilizing step. Two to four stages are preferably used. The amount of replenishment is from 1 to 50 times, preferably from 2 to 30 times and more preferably from 2 to 15 times the amount of processing solution carried over from the preceding bath per a unit area of the color light-sensitive material.

Water suitable for use in the water washing step or the stabilizing step includes city (tap) water, water that has been deionized, for example, by ion exchange resins to reduce Ca and Mg concentrations to 5 mg/liter or below, or water that has been sterilized, for example, by a halogen lamp or a bactericidal ultraviolet lamp.

When continuous processing is performed using an automatic developing machine, concentration of the processing solution tends to occur by evaporation in each step of the processing of color light-sensitive materials. This phenomenon particularly occurs in a case wherein a small amount of color light-sensitive materials is processed or wherein an open area of the processing solution is large. In order to compensate for such concentration of processing solution, it is preferred to replenish them with an appropriate amount of water or a correcting solution.

A technique of introducing an over-flow from the water-washing or stabilizing step into the pre-bath of the bath having fixing ability serves to reduce the amount of waste liquor.

The light-sensitive materials to be processed according to the present invention may be those which comprise a support having provided thereon at least one of blue-sensitive silver halide emulsion layer, green-sensitive silver halide emulsion layer and red-sensitive silver halide emulsion layer, and are not particularly limited as to the number and the order of silver halide emulsion layers and light-insensitive layers. A typical silver halide photographic material comprises a support having provided thereon at least one light-sensitive layer composed of plural silver halide emulsion layers having substantially the same color sensitivity but having different sensitivities, said light-sensitive layer being a unit light-sensitive layer having color sensitivity to any of blue light, green light and red light. In multi-layered silver halide color photographic materials, the unit light-sensitive layers are provided in the order of red-sensitive layer, green-sensitive layer and blue-sensitive layer from the support side. However, reverse order may be employed depending upon intended purpose, or an order wherein a layer having different light sensitivity is sandwiched between layers having the same color sensitivity may be employed.

Various light-insensitive layers such as interlayers may be provided between the silver halide light-sensitive layers or as an uppermost or lowermost layer.

The interlayer may contain couplers, DIR compounds, etc. as described in JP-A-61-43748, JP-A-59-113438, JP-A-59-113440, JP-A-61-20037 and JP-A-61-20038, and color mixing-preventing agents used commonly.

Plural silver halide emulsion layers constituting each unit light-sensitive layer preferably have a two-layer structure of high-speed emulsion layer and slow-speed emulsion layer as described in West German Patent 1,121,470 or British Patent 923,045. Usually, they are disposed in such order that the sensitivity decreases towards the support. A light-insensitive layer may be provided between the silver halide emulsion layers. In addition, the slow-speed emulsion layer may be provided at a position further the support, and the high-speed emulsion layer may be provided at a position nearer the support as described in JP-A-57-112751, JP-A-62-200350, JP-A-62-206541 and JP-A-62-206543.

As specific examples, the layers may be provided in the order, from the further side of the support, a slow speed blue-sensitive layer (BL)/ a high-speed blue-sensitive layer (BH)/ a high-speed green-sensitive layer (GH)/ a slow-speed green-sensitive layer (GL)/ a high-speed red-sensitive layer (RH)/ a slow-speed red-sensitive layer (RL), or in the order of BH/BL/GL/GH/RH/RL or in the order of BH/BL/GH/GL/RL/RH.

As described in JP-B-55-34932, it is also possible to provide in the order of blue-sensitive layer/GH/RH/GL/RL from the furthest side of the support. In addition, as is described in JP-A-56-25738 and JP-A-62-63936, an order of blue sensitive layer/GL/RL/GH/RH from the furthest side of the support may be employed.

As is described in JP-B-49-15495, an order wherein three layers having different sensitivities are arranged in such order that sensitivity is decreased towards the support, i.e., an order of a silver halide emulsion layer having the highest sensitivity (top layer), a silver halide emulsion layer having a middle sensitivity (middle layer), and a silver halide emulsion layer having the lowest sensitivity (bottom layer) may also be employed.

In this case, too, the three layers with the same color sensitivity may be disposed in the order of a medium-speed emulsion layer having middle sensitivity/ a high-speed emulsion layer having the highest sensitivity/ a slow-speed emulsion layer having the lowest sensitivity as described in JP-A-59-202464.

As is described above, various layer structures and orders of the layers may be selected according to the purpose of each of light-sensitive materials.

Silver halide preferably incorporated in the photographic emulsion layers of the photographic light-sensitive material of the present invention is silver bromoiodide, silver chloroiodide or silver chlorobromoiodide having a silver iodide content of about 30 mol % or less. Particularly preferable silver halide is silver bromoiodide or silver chlorobromoiodide having a silver iodide content of from about 2 mol % to about 25 mol %.

Silver halide grains in the photographic emulsion may have a regular crystal form such as cubic, octahedral or tetradecahedral form, an irregular form such as spherical or plate form, a form with crystal defect such as twin plane, or a composite form thereof.

With respect to the grain size of silver halide grains, both fine grains of not larger than about 0.2 μm and large-sized grains of up to about 10 μm in projected area diameter may be used. The emulsion may be a polydisperse emulsion or a monodisperse emulsion.

The silver halide photographic emulsion to be used in the present invention may be prepared according to processes described in, for example, Research Disclosure (RD), No. 17643 (Dec., 1978), pp. 22-23, *I. Emulsion preparation and types* and ibid., No. 18716 (Nov., 1979), p. 648, P. Glafkides; Chemic et *Phisique Photographique*, Paul Montel, 1967, G. F. Duffin; *Photographic Emulsion Chemistry* (Focal Press, 1966), V. L. Zelikman et al; *Making and Coating Photographic Emulsion*, Focal Press, 1964, etc.

Monodisperse emulsions described in U.S. Pat. Nos. 3,574,628 and 3,655,394 and British patent 1,413,748 are also preferred.

Tabular grains having an aspect ratio of from about 5 or more can also be used in the present invention. Such tabular grains may be easily prepared according to processes described in Gutoff; *Photographic Science and Engineering*, vol. 14, pp. 248-257 (1970), U.S. Pat. Nos. 4,434,226, 4,414,310, 4,433,048, 4,439,520 and British patent 2,112,157.

Crystal structure may be a uniform structure, a structure wherein the inner portion and the outer portion are different from each other in halide composition, or a layered structure, or silver halide crystals different from each other may be conjuncted to each other by epitacial conjunction or, further, crystals conjuncted to other compounds than silver halide such as silver rhodanine or lead oxide may be used. In addition, a mixture of grains of various crystal forms may also be used.

The silver halide emulsions to be used in the present invention are usually subjected to physical ripening, chemical ripening, and spectral sensitization before use. Additives to be used in these steps are described in Research Disclosure Nos. 17643 and 18716. Places where such additives are described are shown in the table to be shown hereinafter.

Known photographic additives to be used in the present invention are also described in the above-described two Research Disclosure numbers, and places where they are described are also shown in the following table.

| Kind of Additive | RD17643 | RD18716 |
|---|---|---|
| 1. Chemical sensitizers | p.23 | p.648, right col |
| 2. Sensitivity increasing agents | — | do. |
| 3. Spectral sensitizing agents and Super-sensitizing agents | pp.23-24 | p.648, right col. to p.649, right col. |
| 4. Brightening agents | p.24 | — |
| 5. Antifoggants and stabilizers | pp.24-25 | p.649, right col. |
| 6. Light absorbents, filter dyes, and UV ray absorbents | pp.25-26 | p.649, right col. to p.650, left col. |
| 7. Antistaining agents | p.25, right col. | p.650, left to right col. |
| 8. Dye image stabilizers | p.25 | — |
| 9. Hardeners | p.26 | p.651, left col. |
| 10. Binders | p.26 | do. |
| 11. Plasticizers and lubricants | p.27 | p.650, right col. |
| 12. Coating aids and surfactants | pp.26-27 | do. |
| 13. Antistatic agents | p.27 | do. |

Various color couplers may be used in the present invention, and specific examples thereof are described in the patents described in the foregoing Research Disclosure (RD), No. 17643, VII-C to G.

As yellow couplers, those described in, for example, U.S. Pat. Nos. 3,933,501, 4,022,620, 4,326,024 and 4,401,752, JP-B-58-10739, British patent 1,425,020 and 1,476,760, etc. are described.

As magenta couplers, 5-pyrazolone type and pyrazoloazole type compounds are preferred, with those described in U.S. Pat. Nos. 4,310,619, 4,351,897, European Patent 73,636, U.S. Pat. Nos. 3,061,432, 3,725,067, Research Disclosure No. 24220 (June, 1984), JP-A-60-33552, Research Disclosure No. 24230 (June, 1984), JP-A-60-43659, U.S. Pat. Nos. 4,500,630 and 4,540,654, etc. being particularly preferable.

As cyan couplers, there are illustrated phenolic and naphtholic couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173,West German (OLS) 3,329,729, European Patent 121,365A, U.S. Pat. Nos. 3,446,622, 4,333,999, 4,451,559, 4,427,767, European Patent 161,626A, etc. are preferred.

As colored couplers for correcting unnecessary absorption of colored dyes, those which are described in Research Disclosure, No. 17643, Item VII-G, U.S. Pat. No. 4,163,670, JP-B-57-39413, U.S. Pat. Nos. 4,004,929 and 4,138,258, British Patent 1,146,368, etc. are preferable.

As couplers capable of forming colored dyes with a suitable diffusibility, those which are described in U.S. Pat. No. 4,366,237, British Patent 2,125,570, European Patent 96,570, and West German Patent (OLS) 3,234,533 are preferred.

Typical examples of polymerized dye-forming couplers are described in U.S. Pat. Nos. 3,451,820, 4,080,211, 4,367,282 and British Patent 2,102,173.

Couplers capable of releasing a photographically useful residue upon coupling reaction are also preferably used in the present invention. As DIR couplers capable of releasing a development inhibitor, those which are described in patents described in the foregoing RD 17643, Item VII-F, JP-A-57-151944, JP-A-57-154234, JP-A-60-184248, and U.S. Pat. No. 4,248,962 are preferred.

As couplers capable of imagewise releasing a nucleating agent or a development accelerator upon development, those which are described in British patents 2,097,140 and 2,131,188, JP-A-59-157638 and JP-A-59-170840 are preferred.

As further couplers to be used in the light-sensitive material of the present invention, there are illustrated competitive couplers described in U.S. Pat. No. 4,130,427, etc., polyequivalent couplers described in U.S. Pat. Nos. 4,283,472, 4,338,393, 4,310,618, etc., DIR redox compound-releasing couplers described in JP-A-60-185950, couplers capable of being subjected to color-restoration after being released described in European patent 173,302A and the like.

The couplers to be used in the present invention may be introduced into light-sensitive materials by various known dispersing processes.

Examples of high-boiling organic solvents to be used in the oil-in-water dispersion process are described in U.S. Pat. No. 2,322,027, etc.

In addition, there are processes of using a polymer as coupler-dispersing medium, and various descriptions are given in JP-B-48-30494, U.S. Pat. No. 3,619,195, West German Patent 1,957,467, and JP-B-51-39835.

Steps and advantages of the latex dispersion process and specific examples of latex for impregnation are described in U.S. Pat. No. 4,199,363, West German Patent (OLS) Nos. 2,541,274 and 2,541,230, etc.

Suitable supports to be used in the present invention are described in, for example, the aforesaid RD, No. 17643, p.28 and ibid., No. 18716, p.647, right column to p.648, left column.

The present invention is now illustrated in greater detail by reference to the following examples which, however, are not to be construed as limiting the present invention in any way.

EXAMPLE 1

A color light-sensitive material comprising a cellulose triacetate film support having a subbing layer having provided thereon the layers of the following formulations, referred to as sample 101, was prepared. (Formulation of light-sensitive layer)

The compositions of the layers are shown below. The numeral indicated is the coating amount (g/m$^2$), wherein the coating amount of silver halide is shown as the calculated silver amount.

The coated amount of sensitizing dye is represented molar amounts per 1 mol of silver halide incorporated in the same layer.

| | |
|---|---|
| 1st layer (antihalation layer) | |
| Black colloidal silver | 0.2 (as silver) |
| Gelatin | 1.0 |
| UV ray absorbent, UV-1 | 0.05 |
| UV ray absorbent, UV-2 | 0.1 |
| UV ray absorbent, UV-3 | 0.1 |
| Dispersing oil, OIL-1 | 0.02 |
| 2nd layer (interlayer) | |
| Fine-grained silver bromide (mean grain size: 0.07 μm) | 0.15 |
| Gelatin | 1.0 |
| 3rd layer (first red-sensitive emulsion layer) | |
| Monodisperse silver bromoiodide emulsion (AgI: 6 mol %, mean grain size: 0.4 μm; coefficient of variation: 15% | 1.42 (as silver) |
| Gelatin | 0.9 |
| Sensitizing dye A | $2.0 \times 10^{-4}$ |
| Sensitizing dye B | $1.0 \times 10^{-4}$ |
| Sensitizing dye C | $0.3 \times 10^{-4}$ |

-continued

| | |
|---|---|
| Cp-b | 0.35 |
| Cp-c | 0.052 |
| Cp-d | 0.047 |
| D-1 | 0.023 |
| D-2 | 0.035 |
| HBS-1 | 0.10 |
| HBS-2 | 0.10 |
| 4th layer (interlayer) | |
| Gelatin | 0.8 |
| Cp-b | 0.10 |
| HBS-1 | 0.05 |
| 5th layer (second red-sensitive emulsion layer) | |
| Monodisperse silver bromoiodide emulsion (AgI: 6 mol %; mean grain size: 0.5 μm; coefficient of variation: 15%) | 1.38 (as silver) |
| Gelatin | 1.0 |
| Sensitizing dye A | $1.5 \times 10^{-4}$ |
| Sensitizing dye B | $2.0 \times 10^{-4}$ |
| Sensitizing dye C | $0.5 \times 10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| 6th layer (third red-sensitive emulsion layer) | |
| Monodisperse silver bromoiodide emulsion (AgI: 7 mol %; mean grain size: 1.1 μm; variation coefficient: 16%) | 2.08 (as silver) |
| Gelatin | 1.5 |
| Gp-a | 0.060 |
| Cp-c | 0.024 |
| Cp-d | 0.038 |
| D-1 | 0.006 |
| HBS-1 | 0.12 |
| 7th layer (interlayer) | |
| Gelatin | 1.0 |
| Cpd-A | 0.05 |
| HBS-2 | 0.05 |
| 8th layer (first green-sensitive layer) | |
| Monodisperse AgBrI emulsion: (AgI: 3 mol %; mean grain size: 0.4 μm; coefficient of variation: 19%) | 0.64 (as silver) |
| Monodisperse AgBrI emulsion (AgI: 6 mol %; mean grain size: 0.7 μm; coefficient of variation: 18%) | 1.12 (as silver) |
| Gelatin | 1.0 |
| Sensitizing dye D | $1 \times 10^{-4}$ |
| Sensitizing dye E | $4 \times 10^{-4}$ |
| Sensitizing dye F | $1 \times 10^{-4}$ |
| Cp-h | 0.20 |
| Cp-i | 0.61 |
| Cp-g | 0.084 |
| Cp-k | 0.035 |
| Cp-l | 0.936 |
| D-3 | 0.041 |
| D-4 | 0.018 |
| HBS-1 | 0.25 |
| HBS-2 | 0.45 |
| 9th layer (second green-sensitive emulsion layer) | |
| Monodisperse AgBrI emulsion (AgI: 7 mol %; mean grain size: 1.0 μm; coefficient of variation: 18%) | 2.07 (as silver) |
| Gelatin | 1.5 |
| Sensitizing dye D | $1.5 \times 10^{-4}$ |
| Sensitizing dye E | $2.3 \times 10^{-4}$ |
| Sensitizing dye F | $1.5 \times 10^{-4}$ |
| Cp-f | 0.007 |
| Cp-h | 0.012 |
| Cp-g | 0.009 |
| HBS-2 | 0.088 |
| 10th layer (interlayer) | |
| Yellow colloidal silver | 0.06 |
| Gelatin | 1.2 |
| Cpd-A | 0.3 |
| HBS-1 | 0.3 |
| 11th layer (first blue-sensitive emulsion layer) | |
| Monodisperse AgBrI emulsion (AgI: 6 mol %; mean grain size: 0.4 μm; coefficient of variation: 20%) | 0.31 (as silver) |

-continued

| | |
|---|---|
| Monodisperse AgBrI emulsion (AgI: 5 mol %; mean grain size: 0.9 μm; coefficient of variation: 17%) | 0.38 (as silver) |
| Gelatin | 2.0 |
| Sensitizing dye G | $1 \times 10^{-4}$ |
| Sensitizing dye H | $1 \times 10^{-4}$ |
| Cp-i | 0.63 |
| Cp-j | 0.57 |
| D-1 | 0.020 |
| D-4 | 0.015 |
| HBS-1 | 0.05 |
| 12th layer (second blue-sensitive emulsion layer) | |
| Monodisperse AgBrI emulsion (AgI: 8 mol %; mean grain size: 1.3 μm; coefficient of variation: 18%) | 0.77 (as silver) |
| Gelatin | 0.5 |
| Sensitizing dye G | $5 \times 10^{-5}$ |
| Sensitizing dye H | $5 \times 10^{-5}$ |
| Cp-i | 0.10 |
| Cp-j | 0.10 |
| D-4 | 0.005 |

-continued

| | |
|---|---|
| HBS-2 | 0.10 |
| 13th layer (interlayer) | |
| Gelatin | 0.5 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| 14th layer (protective layer) | |
| Monodisperse AgBrI emulsion (AgI: 4 mol %; mean grain size: 0.05 μm; coefficient of variation: 10%) | 0.1 (as silver) |
| Gelatin | 1.5 |
| Polymethyl methacrylate particles (mean particle size: 1.5 μm) | 0.1 |
| S-1 | 0.2 |
| S-2 | 0.2 |

In addition, a surfactant, K-1, and a gelatin hardener, H-1, were added thereto.

Sensitizing dye A

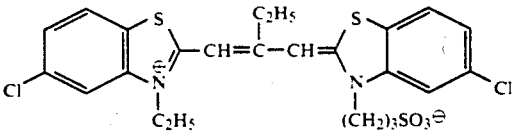

Sensitizing dye B

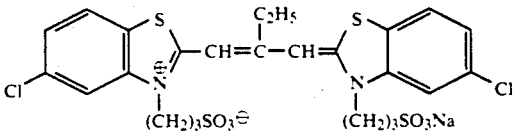

Sensitizing dye C

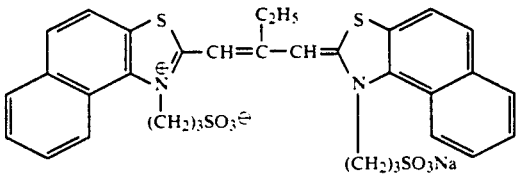

Sensitizing dye D

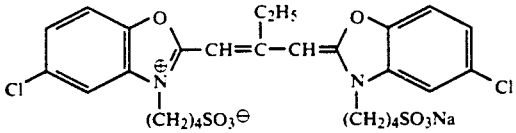

Sensitizing dye E

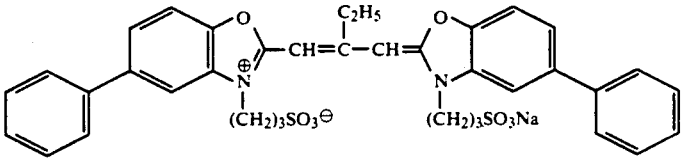

Sensitizing dye F

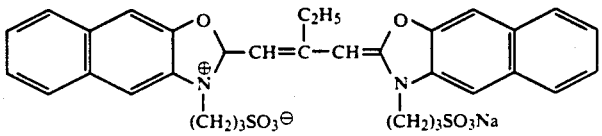

Sensitizing dye G

-continued
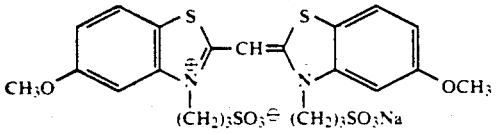
Sensitizing dye H
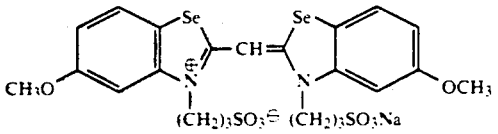
D-1
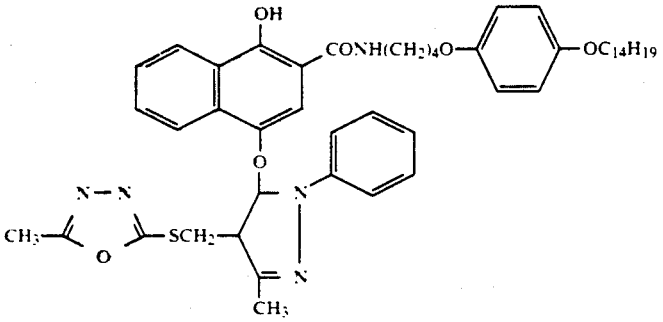
D-2
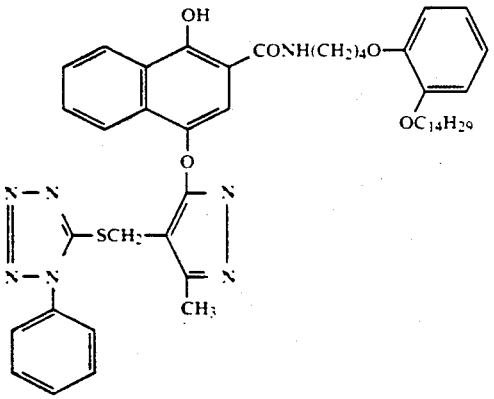
D-3
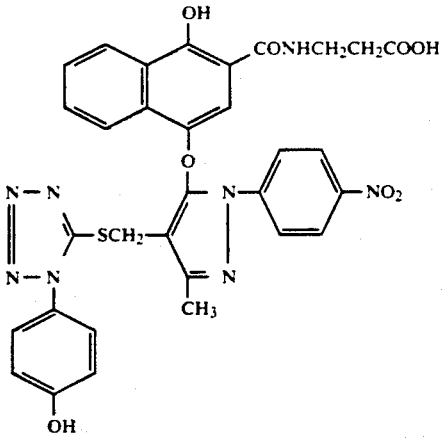
D-4

-continued
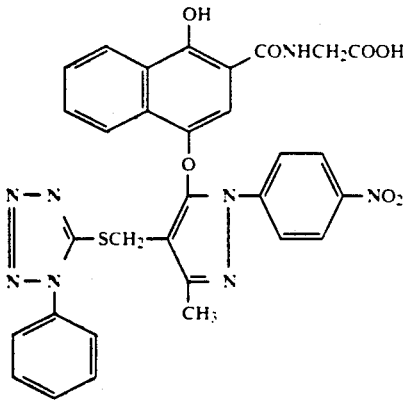
OIL-1
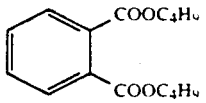
Cp-a
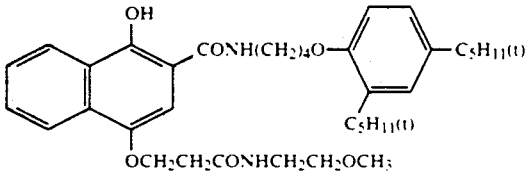
Cp-b
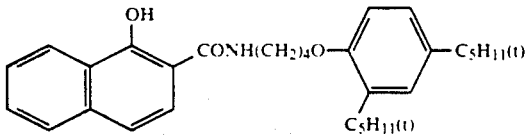
Cp-c
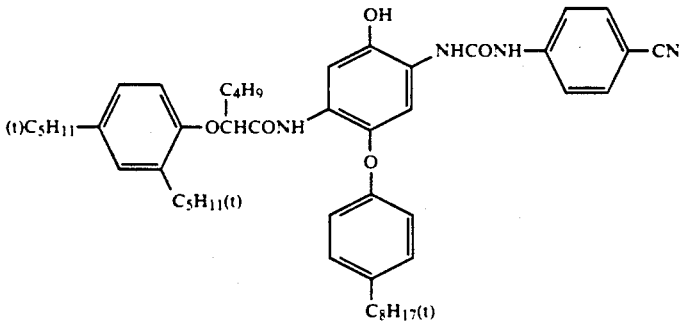
Cp-d -continued
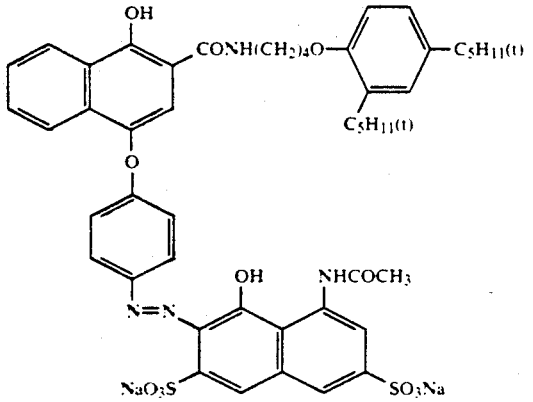
Cp-f
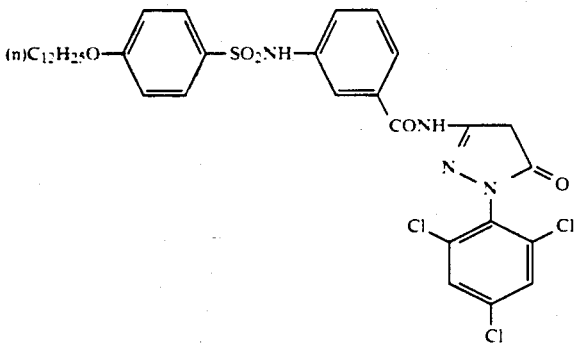
Cp-g
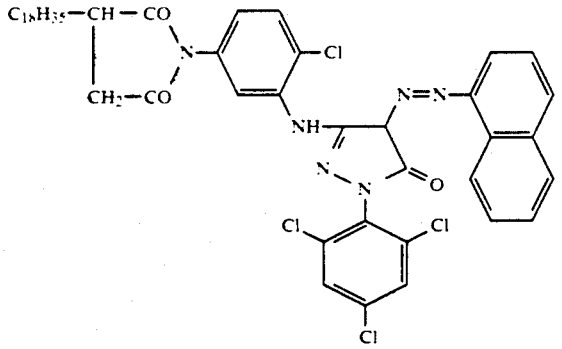
Cp-h
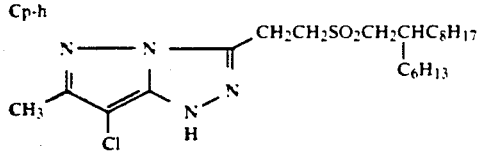
Cp-i
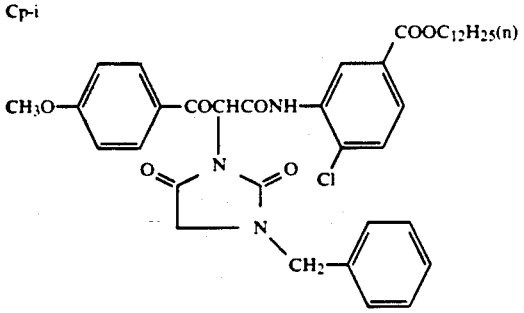
Cp-j -continued
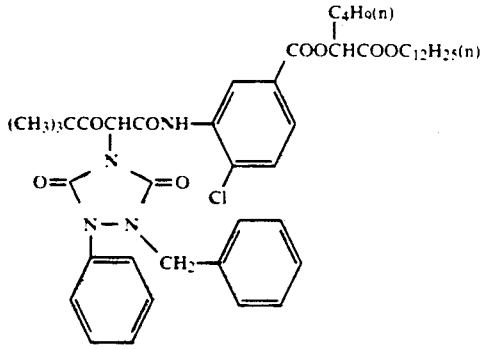
Cp-k
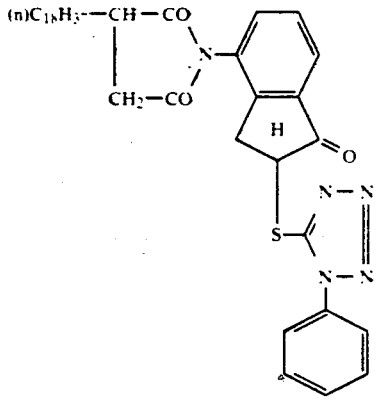
Cp-l
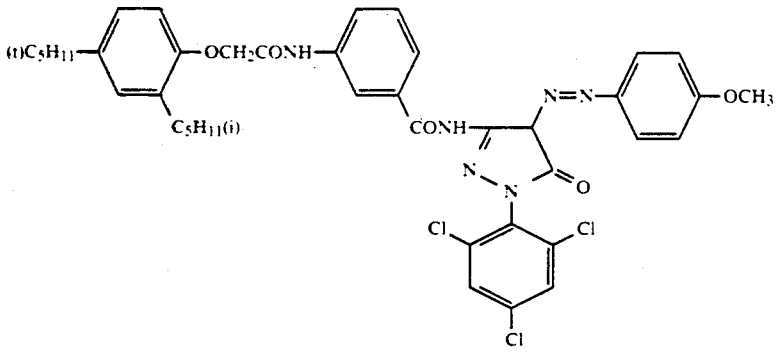
Cp-m
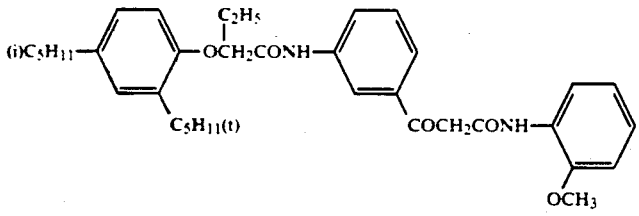
HBS-1
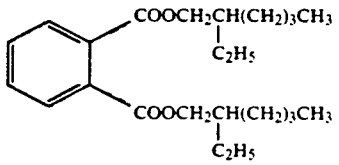
HBS-2

-continued

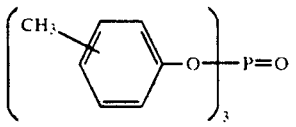

K-1

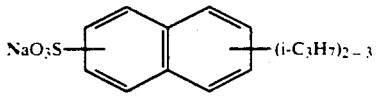

S-1

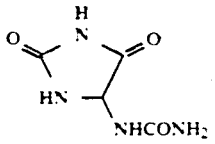

S-2

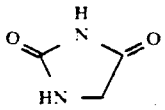

UV-1

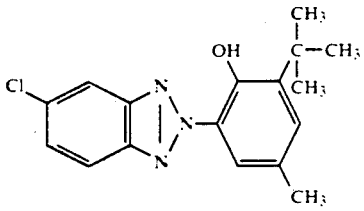

UV-2

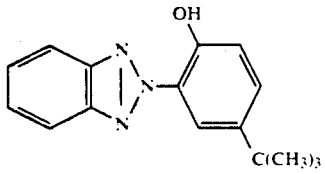

UV-3

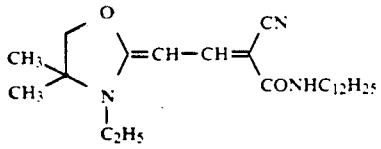

Compound Cpd-A

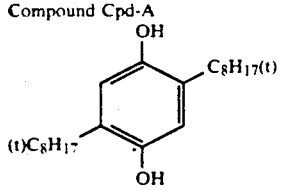

H-1

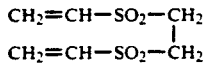

Preparation of samples 102 to 104

Samples 102 to 104 were prepared in the same manner as sample 101 except that couplers of the present invention shown in Table 1 were added to the 4th and the 5th layers of sample 101 in an equimolar amount in place of Cp-b.

Samples thus prepared were cut into 35-mm size pieces, and then a standard subject was photographed using them. The sample pieces were then subjected to the following processing steps in a continuous manner till the color developer was replenished in a volume 2 times as much as the volume of the tank of the color developer. Formulation of the bleaching solution was changed as shown in Table 1, and processing was conducted with each formulation.

Additionally, the automatic developing machine used is of a belt-conveying type described in JP-A-60-191257, and each processing bath employs a jet-stirring technique described in JP-A-62-183460.

Processing steps are shown below.

| Step | Processing Time | Temperature | Replenishing Amount (per 35-mm width × 1 m) |
|---|---|---|---|
| Color development | 3 min and 15 sec | 38° C. | 38 ml |
| Bleaching | 40 sec | 38° C. | 4 ml |
| Fixing | 1 min | 38° C. | 30 ml |
| Stabilizing 1 | 20 sec | 38° C. | — |
| Stabilizing 2 | 20 sec | 38° C. | — |
| Stabilizing 3 | 20 sec | 38° C. | 35 ml* |
| Drying | 1 min and 15 sec | 50-70° C. | — |

*Stabilizing solution was used in a 3-tank counter current method of stabilizing 3 → stabilizing 2 → stabilizing 1

Formulations of respective processing solutions used are shown below.

| (Color developer) | Mother Liquor (Tank solution) (g) | Replenisher (g) |
|---|---|---|
| Diethylenetriaminepentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 mg | — |
| Hydroxylamine sulfate | 2.0 | 2.8 |
| 4-(N-Ethyl-N-β-hydroxyethylamino)-2-methylaniline sulfate | 4.7 | 5.3 |
| Water to make | 1.0 l | 1.0 l |
| pH | 10.00 | 10.05 |

| (Bleaching solution) | Mother Liquor (Tank solution) | Replenisher |
|---|---|---|
| Iron(III) ethylenediaminetetraacetate ammonium dihydrate (EDTA.Fe) | See Table 1 | |
| Iron(III) ammonium 1,3-diaminopropanetetraacetate (1,3-DPTA.Fe) | " | |
| Bleaching accelerator* | " | |
| 1,3-Diaminopropanetetraacetic acid | 4.0 g | 5.0 g |
| Ammonium bromide | 100.0 g | 160.0 g |

-continued

| | | |
|---|---|---|
| Ammonium nitrate | 30.0 g | 50.0 g |
| Aqueous ammonia (27 wt %) | 20.0 ml | 23.0 ml |
| Acetic acid (98 wt %) | 9.0 ml | 15.0 ml |
| Water to make | 1.0 l | 1.0 l |
| pH | See Table 1 | |

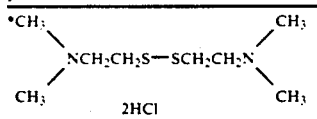

| (Fixing solution) | Mother Liquor (Tank solution) | Replenisher |
|---|---|---|
| 1-Hydroxyethylidene-1,1-diphosphonic acid | 5.0 g | 6.0 g |
| Sodium sulfite | 7.0 g | 8.0 g |
| Sodium bisulfite | 5.0 g | 5.5 g |
| Ammonium thiosulfate aq. soln. (700 g/l) | 170.0 ml | 200.0 ml |
| Water to make | 1.0 l | 1.0 l |
| pH | 6.7 | 6.6 |

| (Stabilizing solution) | Mother liquor (Tank solution) and replenisher were the same in formulation. |
|---|---|
| Formalin (37 wt %) | 1.2 ml |
| 5-Chloro-2-methyl-4-isothiazolin-3-one | 6.0 ml |
| 2-Methyl-4-isothiazolin-3-one | 3.0 mg |
| Surfactant $[C_{10}H_{21}—O—(CH_2CH_2O)_{10}H$ | 0.4 g |
| Ethylkene glycol | 1.0 g |
| Water to make | 1.0 l |
| pH | 5.0-7.0 |

The aforesaid samples were exposed in an exposure amount of 20 CMS, and then processed in each running equilibrium solution. The residual silver amount is measured by fluorescent X-ray method. The results obtained are shown in Table 1.

The use of bleaching solutions containing the bleaching agents in the proportion of the present invention enabled to reduce the residual silver amount, which itself clearly revealed the effect of accelerating the removing silver (resilvering) and, when combined with the coupler of the present invention, there results significantly increased effects in comparison with independent use of the bleaching solution of the coupler. Further, when the pH of the bleaching solution is decreased, the effect of accelerating the resilvering is increased.

The above-described effect is quite surprising to even those skilled in the art and is not obvious at all.

TABLE 1

| Exp. No. | Sample No. | Coupler in 4th and 5th layers | Bleaching Agent Ratio (sum 0.3 mol/l) EDTA.Fe/1,3DPTA.Fe | pH of Bleaching Bath | Amount of residual silver (μg/cm²) |
|---|---|---|---|---|---|
| 1 | 101 (Comparison) | Cp-b | 4 | 5.15 | 64 |
| 2 | 102 (Comparison) | B-1 | 4 | 5.15 | 40 |
| 3 | 103 (Comparison) | B-7 | 4 | 5.15 | 38 |
| 4 | 104 (Comparison) | B-24 | 4 | 5.15 | 36 |
| 5 | 101 (Comparison) | Cp-b | 3 | 5.15 | 51 |
| 6 | 102 (Invention) | B-1 | 3 | 5.15 | 5 |
| 7 | 103 (Invention) | B-7 | 3 | 5.15 | 3 |
| 8 | 104 (Invention) | B-24 | 3 | 5.15 | 2 |
| 9 | 101 (Comparison) | Cp-b | 1 | 5.15 | 42 |
| 10 | 102 (Invention) | B-1 | 1 | 5.15 | 3 |
| 11 | 103 (Invention) | B-7 | 1 | 5.15 | 2 |
| 12 | 104 (Invention) | B-24 | 1 | 5.15 | 3 |
| 13 | 101 (Comparison) | Cp-b | 0.5 | 4.9 | 24 |
| 14 | 102 (Invention) | B-1 | 0.5 | 4.9 | 2 |
| 15 | 103 (Invention) | B-7 | 0.5 | 4.9 | 1 |
| 16 | 104 (Invention) | B-24 | 0.5 | 4.9 | 1 |
| 17 | 101 (Comparison) | Cp-b | 0.5 | 6.0 | 32 |

TABLE 1-continued

| Exp. No. | Sample No. | Coupler in 4th and 5th layers | Bleaching Agent Ratio (sum 0.3 mol/l) EDTA.Fe/1.3DPTA.Fe | pH of Bleaching Bath | Amount of residual silver (μg/cm²) |
|---|---|---|---|---|---|
| 18 | 102 (Invention) | B-1 | 0.5 | 6.0 | 8 |
| 19 | 103 (Invention) | B-7 | 0.5 | 6.0 | 7 |
| 20 | 104 (Invention) | B-24 | 0.5 | 6.0 | 7 |
| 21 | 101 (Comparison) | Cp-b | 0.5 | 5.8 | 30 |
| 22 | 102 (Invention) | B-1 | 0.5 | 5.8 | 6 |
| 23 | 103 (Invention) | B-7 | 0.5 | 5.8 | 6 |
| 24 | 104 (Invention) | B-24 | 0.5 | 5.8 | 5 |
| 25 | 101 (Comparison) | Cp-b | 0.5 | 5.3 | 29 |
| 26 | 102 (Invention) | B-1 | 0.5 | 5.3 | 3 |
| 27 | 103 (Invention) | B-7 | 0.5 | 5.3 | 4 |
| 28 | 104 (Invention) | B-24 | 0.5 | 5.3 | 3 |

EXAMPLE 2

A multi-layered color light-sensitive material, 201, was prepared by coating layers having the following formulations on a cellulose triacetate film support having a small layer. (Formulation of light-sensitive layer)

The compositions of the layers are shown below. The numeral indicated is the coating amount (g/m²) wherein the coating amount of silver in the coating amount, wherein the coating amount of silver halide is shown as the calculated silver amount. The coated amount of sensitizing dye is represented molar amounts per 1 mol of silver halide incorporated in the same layer.

| | |
|---|---|
| **1st layer (antihalation layer)** | |
| Black colloidal silver | 0.18 (as silver) |
| Gelatin | 0.40 |
| **2nd layer (interlayer)** | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| **3rd layer (first red-sensitive emulsion layer)** | |
| Monodisperse AgBrI emulsion (AgI: 6 mol %, mean grain size: 0.6 μm; variation coefficient with grain size: 0.15) | 0.55 (as silver) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| **4th layer (second red-sensitive emulsion layer)** | |
| Tabular grain AgBrI emulsion (AgI: 10 mol %; mean grain size: 0.7 μm; mean aspect ratio: 5.5; mean thickness: 0.2 μm) | 1.0 (as silver) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.050 |
| EX-10 | 0.015 |
| Gelatin | 1.30 |
| **5th layer (third red-sensitive emulsion layer)** | |
| AgBrI emulsion (AgI: 16 mol %; mean grain size: 1.1 μm) | 1.60 (as silver) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |

-continued

| | |
|---|---|
| EX-3 | 0.240 |
| EX-4 | 0.120 |
| HBS-1 | 0.22 |
| HBS-2 | 0.10 |
| Gelatin | 1.63 |
| **6th layer (interlayer)** | |
| EX-5 | 0.040 |
| HBS-1 | 0.020 |
| EX-12 | 0.004 |
| Gelatin | 0.80 |
| **7th layer (first green-sensitive emulsion layer)** | |
| Tabular grain AgBrI emulsion (AgI: 6 mol %; mean grain size: 0.6 μm; mean aspect ratio: 6.0; mean thickness: 0.15) | 0.40 (as silver) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| **8th layer (second green-sensitive emulsion layer)** | |
| Monodisperse AgBrI emulsion (AgI: 9 mol %; mean grain size: 0.7 μm; variation coefficient with grain size: 0.18) | 0.80 (as silver) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| **9th layer (third green-sensitive emulsion layer)** | |
| AgBrI emulsion (AgI: 12 mol %; mean grain size: 1.0 μm) | 1.2 (as silver) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| **10th layer (yellow filter layer)** | |
| Yellow colloidal silver | 0.05 (as silver) |
| EX-5 | 0.08 |
| HBS-3 | 0.03 |
| Gelatin | 0.95 |
| **11th layer (first blue-sensitive emulsion layer)** | |
| Tabular grain AgBrI emulsion (AgI: 6 mol %; mean grain size: 0.6 μm; mean aspect ratio: 5.7; mean thickness: 0.15) | 0.24 (as silver) |
| Sensitizing dye VIII | $3.5 \times 10^{-4}$ |

-continued

| | |
|---|---|
| EX-9 | 0.85 |
| EX-8 | 0.12 |
| HBS-1 | 0.28 |
| Gelatin | 1.28 |
| 12th layer (second blue-sensitive emulsion layer) | |
| Monodisperse AgBrI emulsion (AgI: 10 mol %; mean grain size: 0.8 μm; variation coefficient with grain size: 0.16) | 0.45 (as silver) |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| 13th layer (third blue-sensitive emulsion layer) | |
| AgBrI emulsion (AgI: 14 mol %; mean grain size: 1.3 μm) | 0.77 (as silver) |
| Sensitizing dye VIII | $2.2 \times 10^{-4}$ |
| EX-9 | 0.20 |

-continued

| | |
|---|---|
| HBS-1 | 0.07 |
| Gelatin | 0.69 |
| 14th layer (first protective layer) | |
| AgBrI emulsion (AgI: 1 mol %; mean grain size: 0.07 μm) | 0.5 (as silver) |
| U-4 | 0.11 |
| U-5 | 0.17 |
| HBS-1 | 0.90 |
| Gelatin | 1.00 |
| 15th layer (second protective layer) | |
| Polymethyl acrylate particles (diameter: about 1.5 μm) | 0.54 |
| S-1 | 0.15 |
| S-2 | 0.05 |
| Gelatin | 0.72 |

In addition to the above-described components, a gelatin hardener, H-1, and surfactants, W-1 and W-2 were added to each layer.

U-1

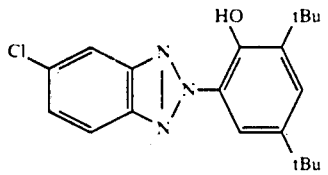

U-2

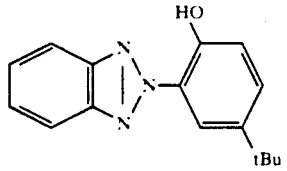

U-3

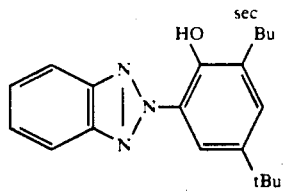

U-4

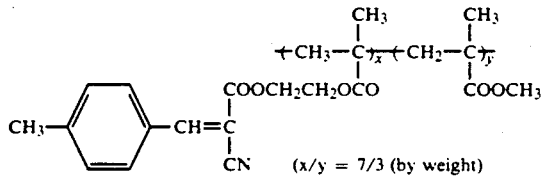

(x/y = 7/3 (by weight))

U-5

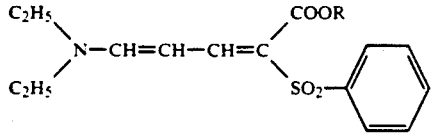

R = $C_8H_{17}$

-continued
EX-1
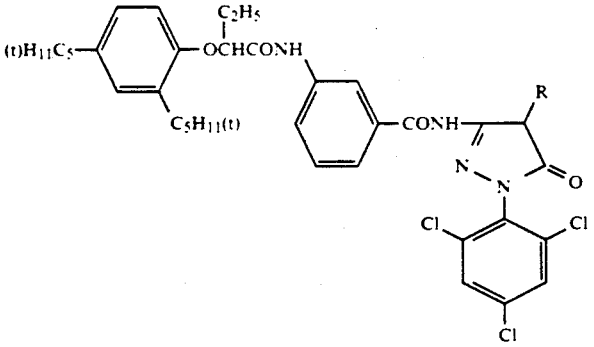
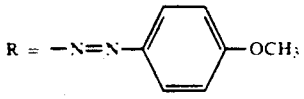
EX-2
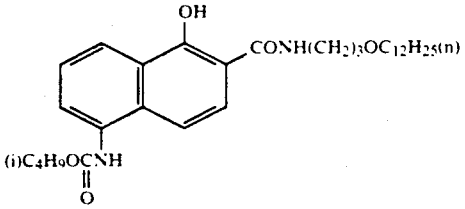
EX-3
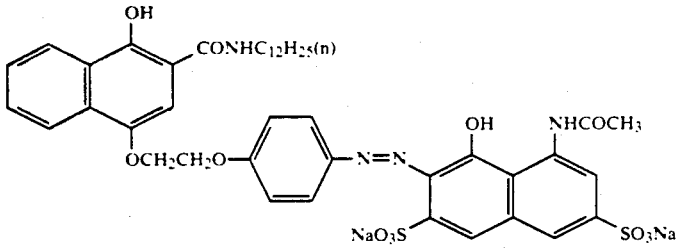
EX-4
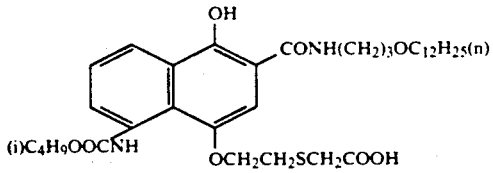
EX-5
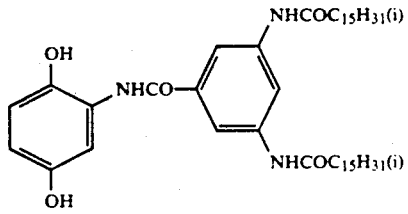

-continued
EX-6
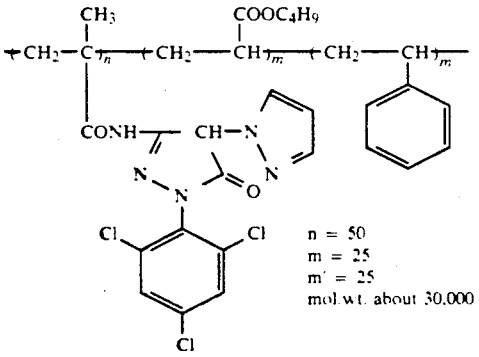
EX-7
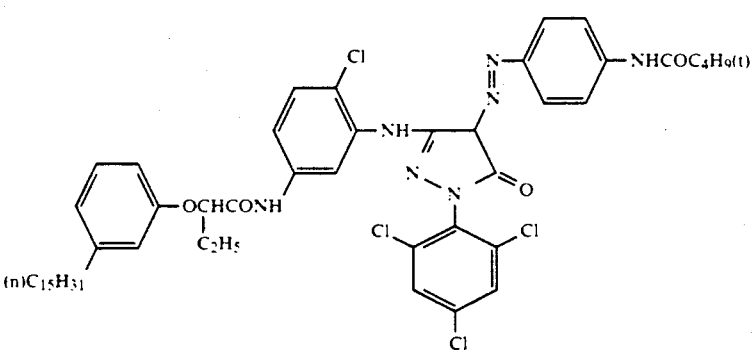
EX-8
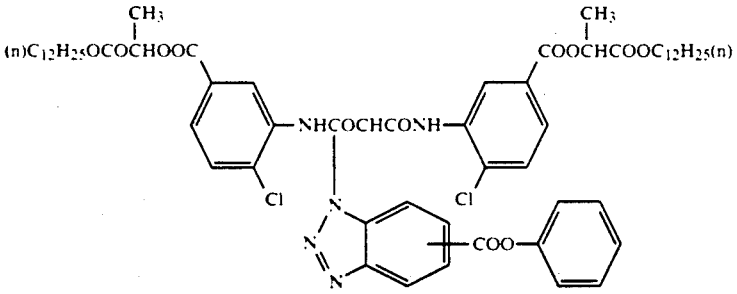
EX-9
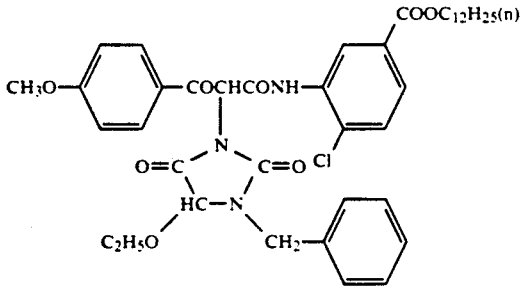

-continued
EX-10
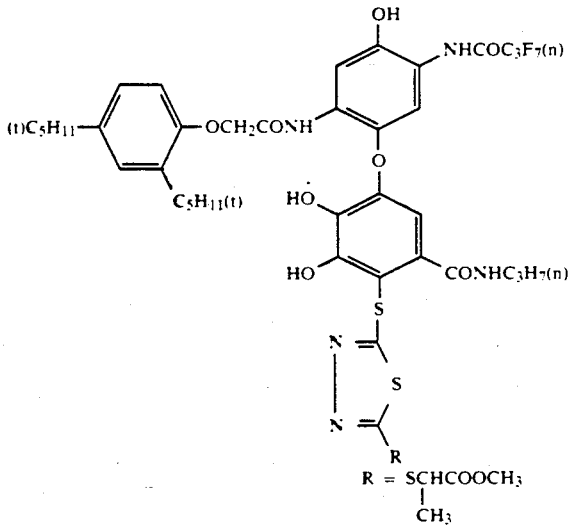
EX-11
same as EX-1 (provided that R is H)
EX-12
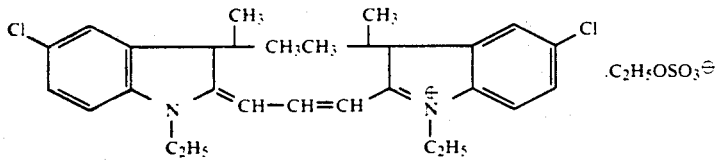
S-1
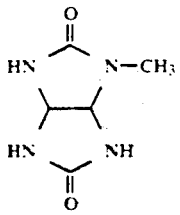
S-2
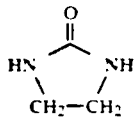
Tricresyl phosphate HBS-1
Dibutyl phthalate HBS-2
Bis (2-ethylhexyl) phthalate HBS-3
HBS-4
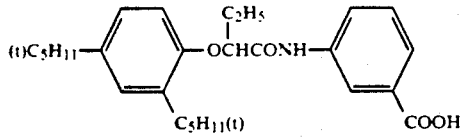
H-1
$CH_2{=}CH{-}SO_2{-}CH_2{-}CONH{-}CH_2$
$CH_2{=}CH{-}SO_2{-}CH_2{-}CONH{-}CH_2$
W-1
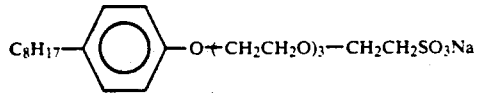
W-2
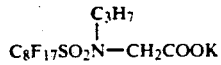
Sensitizing dye -continued
I
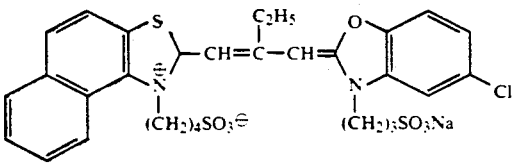
II
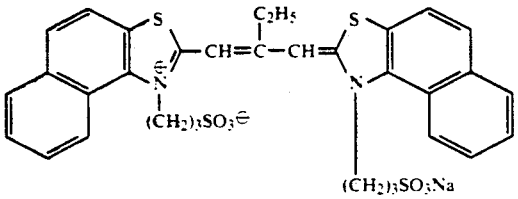
III
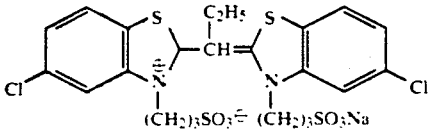
IV
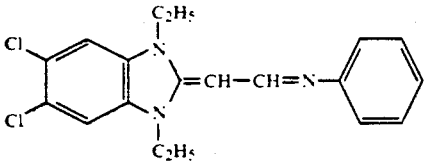
V
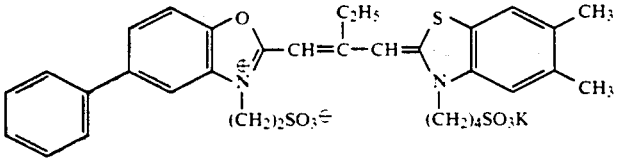
VI
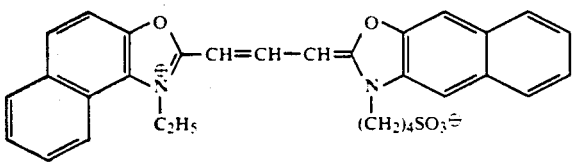
VII
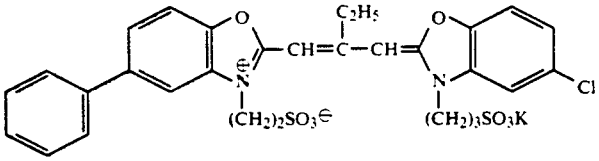
VIII
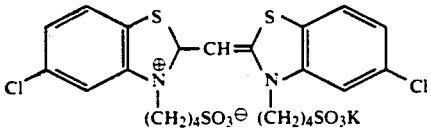
IX
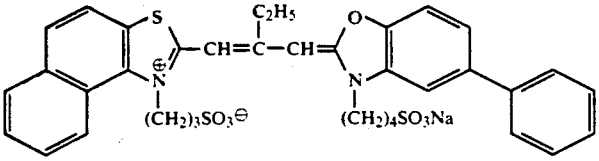

Preparation of samples 202 to 204

Samples 202 to 204 were prepared in the same manner as sample 201 except that coupler B-26, B-27 and B-41 were added to the 7th to 9th layers of sample 201 in an equimolar amount in place of EX-6, respectively.

Samples 201 to 204 thus obtained were introduced into the same processing solutions as in Example 1. The residual silver amount was measured by the same manner as in Example 1. Thus, it was found that the combination of the samples and the processing solution in accordance with the present invention showed remarkable silver-removing properties (i.e., desilvering properties).

Example 3

A bleaching solution not containing the bleaching accelerator added in Example 1 was prepared. Also, bleaching solutions wherein the bleaching accelerator was replaced by equimolar amounts of the aforementioned compounds (IA)-(2), (IA)-(16) and (IA)-(13) were prepared. The same tests as described above were conducted using these baths.

As a result, it was found that the bleaching solution not containing the bleaching accelerator showed still a sufficient effect of the present invention, though the residual silver amount was slightly increased.

Bleaching solutions containing other bleaching accelerators provided the same effects as in Example 1.

Accordingly, it is more preferable to combine the bleaching bath of the present invention with a bleaching accelerator.

While the present invention has been described in detail and with reference to specific embodiments thereof, it will be apparent to one skilled in the art that various changes and modifications can be made therein without departing from the spirit and the scope of the present invention.

What is claimed is:

1. A process for processing an imagewise exposed silver halide color photographic material with a processing solution having a bleaching ability after color development, wherein said silver halide color photographic material contains at least one bleaching accelerator-releasing compound capable of reacting with an oxidation product of a developing agent upon development to release a bleaching accelerator and said processing solution having a bleaching ability has a pH of from 2.0 to 5.3 and contains as a first component (1) at least one ferric complex salt of a compound selected from the Compound Group (A) and as a second component (2) a ferric complex salt of 1,3-diaminopropanetetraacetic acid as bleaching agents in such proportion that the molar ratio of component (1) to component (2) is 3 or less: Compound Group (A)

A-1 ethylenediaminetetraacetic acid

A-2 diethylenetriaminepentaacetic acid

A-3 cyclohexanediaminetetraacetic acid

A-4 1,2-propylenediaminetetraacetic acid;

and wherein the bleaching accelerator-releasing compound is represented by formula (I):

$$A-(T_1)_l-[B-(T_2)_n]_m-Z \quad (I)$$

wherein A represents a group which is split off from $(T_1)_l-[B-(T_2)_n]_m-Z$ upon reaction with an oxidation product of an aromatic primary amine developing agent; $T_1$ and $T_2$ each represents a timing group; B represents a group which is split off from $T_2$ upon reaction with an oxidation product of an aromatic primary amine developing agent after A is split off from $(T_1)_l-[B-(T_2)_n]_m-Z$; l, m and n each represents an integer of 0 or 1; and Z is a group showing a bleach-accelerator effect after B is split off from $T_2$ which can be represented by formula (Z-1l):

$$-S-L_1-(X_1)_a \quad (Z\text{-}1)$$

wherein a represents an integer of from 1 to 4; $L_1$ represents a straight or branched alkylene group of a valency of (a+1) containing 1 to 8 carbon atoms; and $X_1$ represents a hydroxy group, a carboxyl group, a cyano group, an amino group containing 0 to 10 carbon atoms, an acyl group containing 1 to 10 carbon atoms, a heterocyclic thio group containing 1 to 10 carbon atoms, a carbamoyl group containing 1 to 10 carbon atoms, a sulfonyl group containing 1 to 10 carbon atoms, a heterocyclic group containing 1 to 10 carbon atoms, a sulfamoyl group containing 0 to 10 carbon atoms, a carbonamide group containing 1 to 10 carbon atoms, an ammoniumyl group containing 3 to 12 carbon atoms, a ureido group containing 1 to 10 carbon atoms, a sulfamoylamino group containing 0 to 10 carbon atoms, an alkoxy group containing 1 to 6 carbon atoms, an amidino group, a guanidino group or an amidinothio group, provided that, when a represents 2 or more the plurality of $(X_1)$ groups may be the same or different, and further provided that $L_1$ does not represent a cycloalkylene group.

2. The process for processing an imagewise exposed silver halide color photographic material as claimed in claim 1, wherein said bleaching accelerator-releasing compound is added to the silver halide color photographic material in an amount of from $1\times10^{-7}$ mol to $1\times10^{-1}$ mol per $m^2$ of the light-sensitive material.

3. The process for processing an imagewise exposed silver halide color photographic material as claimed in claim 1, wherein said molar ratio of the (1) to the (2) is from 1.8 to 0.5.

4. The process for processing an imagewise exposed silver halide color photographic material as claimed in claim 1, wherein said bleaching agent is added to said processing solution in an amount of from 0.05 mol to 1 mol per liter of said processing solution.

5. The process for processing an imagewise exposed silver halide color photographic material as claimed in claim 1, wherein said silver halide color photographic material comprises a photographic emulsion layer containing silver halide having a silver iodide content of about 30 mol % or less.

6. The process for processing an imagewise exposed silver halide color photographic material as claimed in claim 1, wherein m is 0.

7. The process for processing an imagewise exposed silver halide color photographic material as claimed in claim 1, wherein n is 0.

8. The process for processing an imagewise exposed silver halide color photographic material as claimed in claim 1, wherein A represents a cyan coupler residue.

* * * * *